US007045797B2

(12) United States Patent
Sudakov et al.

(10) Patent No.: US 7,045,797 B2
(45) Date of Patent: May 16, 2006

(54) AXIAL EJECTION WITH IMPROVED GEOMETRY FOR GENERATING A TWO-DIMENSIONAL SUBSTANTIALLY QUADRUPOLE FIELD

(75) Inventors: Mikhail Sudakov, Cheshire (GB); Donald J. Douglas, Vancouver (CA); Chuan-Fan Ding, Vancouver (CA)

(73) Assignee: The University of British Columbia (CA)

( * ) Notice: Subject to any disclaimer, the term of this patent is extended or adjusted under 35 U.S.C. 154(b) by 65 days.

(21) Appl. No.: 10/414,491

(22) Filed: Apr. 16, 2003

(65) Prior Publication Data

US 2004/0108456 A1 Jun. 10, 2004

Related U.S. Application Data

(63) Continuation-in-part of application No. 10/211,238, filed on Aug. 5, 2002.

(51) Int. Cl.
*H01J 49/42* (2006.01)

(52) U.S. Cl. ..... 250/492; 250/288; 250/282

(58) Field of Classification Search ..... 250/492, 250/282, 288
See application file for complete search history.

(56) References Cited

U.S. PATENT DOCUMENTS

| | | | |
|---|---|---|---|
| 2,939,952 | A | 6/1960 | Paul et al. |
| 4,234,791 | A | 11/1980 | Enke et al. |
| 4,328,420 | A | 5/1982 | French |
| 4,329,582 | A | 5/1982 | French et al. |
| 4,535,236 | A | 8/1985 | Batey |

(Continued)

FOREIGN PATENT DOCUMENTS

| | | |
|---|---|---|
| EP | 0 290 712 | 11/1988 |
| EP | 0 459 602 | 6/1991 |
| WO | WO 97/07530 | 2/1997 |

OTHER PUBLICATIONS

James Hager, Mass Spectrometry Using a Linear RF Quadrupole Ion Trap With Axial Ion Ejection, Presented at the 46th ASMS Conference on Mass Spectrometry and Allied Topics, May 31–Jun. 4, 2003, Orlando, Florida.

James W. Hager, Performance Optimization and Fringing Field Modifications of a 24–mm Long RF–only Quadrupole Mass Spectrometer, Rapid Commun. Mass Spectrum, 1999, 740–748, vol. 13, John Wiley & Sons, Ltd.

(Continued)

*Primary Examiner*—John R. Lee
*Assistant Examiner*—Erin-Michael Gill
(74) *Attorney, Agent, or Firm*—Ian C. McMillan; Daniel C. Abeles

(57) ABSTRACT

A mass spectrometer having an elongated rod set, and a method of operating same. The rod set has an entrance end, an exit end and a longitudinal axis. Ions are admitted into the entrance end of the rod set. At least some of the ions are trapped in the rod set by producing a barrier field at an exit member adjacent to the exit end of the rod set and by producing an RF field between the rods of the rod set adjacent at least the exit end of the rod set. The RF and barrier fields interact in an extraction region adjacent to the exit end of the rod set to produce a fringing field. Ions in the extraction region are energized to mass selectively eject at least some ions of a selected mass to charge ratio axially from the rod set past the barrier field. The RF field is a two-dimensional substantially quadrupole field having a quadrupole harmonic with amplitude $A_2$, an octopole harmonic with amplitude $A_4$, and a hexadecapole harmonic with amplitude $A_8$. $A_8$ is less than $A_4$, and $A_4$ is greater than 0.1% of $A_2$.

20 Claims, 21 Drawing Sheets

U.S. PATENT DOCUMENTS

| | | | |
|---|---|---|---|
| 4,882,484 | A | 11/1989 | Franzen et al. |
| 5,051,593 | A | 9/1991 | Ishihara |
| 5,170,054 | A | 12/1992 | Franzen |
| 5,240,425 | A | 8/1993 | Sato et al. |
| 5,420,425 | A | 5/1995 | Bier et al. |
| 5,528,031 | A | 6/1996 | Franzen |
| 5,689,111 | A | 11/1997 | Dresch et al. |
| 5,708,268 | A | 1/1998 | Franzen |
| 5,714,755 | A | 2/1998 | Wells et al. |
| 5,739,530 | A | 4/1998 | Franzen et al. |
| 5,763,878 | A | 6/1998 | Franzen |
| 5,793,048 | A | 8/1998 | Petric et al. |
| 5,825,026 | A | 10/1998 | Baykut |
| 5,838,003 | A | 11/1998 | Bertsch et al. |
| 5,847,386 | A | 12/1998 | Thomson et al. |
| 5,864,136 | A | 1/1999 | Kelley et al. |
| 6,011,259 | A | 1/2000 | Whitehouse et al. |
| 6,020,586 | A | 2/2000 | Dresch et al. |
| 6,075,244 | A | 6/2000 | Baba et al. |
| 6,111,250 | A | 8/2000 | Thomson et al. |
| 6,153,880 | A | 11/2000 | Russ, IV et al. |
| 6,177,668 | B1 | 1/2001 | Hager |
| 6,297,500 | B1 | 10/2001 | Franzen et al. |
| 6,340,814 | B1 | 1/2002 | Vandermey |
| 6,403,955 | B1 | 6/2002 | Senko |
| 6,504,148 | B1 | 1/2003 | Hager |
| 2002/0175279 | A1 | 11/2002 | Hager |
| 2003/0042415 | A1 | 3/2003 | Hager |
| 2004/0051036 | A1 | 3/2004 | Franzen et al. |

OTHER PUBLICATIONS

James W. Hager, A New Linear Ion Trap Mass Spectrometer, Rapid Commun. Mass Spectrum, 2002. 512–526, vol. 16, John Wiley & Sons, Ltd.

D.A. Church, Storage–Ring Ion Trap Derived From the Linear Quadrupole Radio–Frequency Mass Filter, Journal of Applied Physics, Jul. 1969, 3127–3134, vol. 40.

B.I. Deutch, F.M. Jacobsen, L.H. Andersen, P. Hvelplund and H. Knudsen, Antihydrogen Production by Positronium–Antriproton Collision in an Ion Trap, Physica Scripta, 1988, 248–255, vol. T22.

I. Waki, S. Kassner, G. Birkl and H. Walther, Observation of Ordered Structures of Laser–Cooled Ions in a Quadrupole Storage Ring, Physical Review Letters, March 30, 1992, 2007–2013, vol. 68.

James W. Hager and J.C. Yves Le Blanc, Product Ion Scanning Using a Q–q–Qlinear ion trap (Q TRAP) Mass Spectrometer, Rapid, Commun. Mass Spectrom, 1056–1064, vol. 17, published online by Wiley InterScience.

Stephen A. Lammert, Wolfgang R. Plass, Cyril V. Thompson, Marcus B. Wise, Design, Optimization and Initial Performance of a Toroidal RF Ion Trap Mass Spectrometer, International Journal of Mass Spectrometry, 2001, 25–40, vol. 212.

Bruce E. Wilcox, Christopher L. Hendrickson and Alan G. Marshall, "Improved Ion Extraction From a Linear Octopole Ion Trap:SIMION Analysis and Experimental Demonstration", Journal of The American Society For Mass Spectrometry, Nov. 2002, 1304–1312, vol. 13, No. 11, Elsevier Science Inc., New York, New York.

D.J. Douglas, T.A. Glebova, N.V. Konenkov and M. Yu. Sudakov, Spatial Harmonics of the Field in a Quadrupole Mass Filter With Circular Electrodes, Technical Physics, Oct. 1999, 1215–1219, vol. 44, No. 10, American Institute of Physics.

Ma'an H. Amad and R.S. Houk, High–Resolution Mass Spectrometry With a Multiple Pass Quadrupole Mass Analyzer, Analytical Chemistry, Dec. 1, 1998, 4885–4889, vol. 70, No. 23, American Chemical Society.

Ma'an H. Amad and R.S. Houk, Mass Resolution of 11,000 to 22,000 With a Multiple Pass Quadrupole Mass Analyzer, American Society for Mass Spectrometry, 2000, 407–415, vol. 11, Elsevier Science Inc.

Jae C. Schwartz, Michael W. Senko and John E.P. Syka, A Two–Dimensional Quadrupole Ion Trap Mass Spectrometer, American Society for Mass Spectrometry, 2002, 659–669, vol. 13, Elsevier Science Inc.

J.M. Campbell, B.A. Collings and D.J. Douglas, A New Linear Ion Trap Time–of–Flight System With Tandem Mass Spectrometry Capabilities, Rapid Communications in Mass Spectrometry, 1998, 1463–1474, vol. 12, John Wiley & Sons, Ltd.

B.A. Collings, J.M. Campbell, Dunmin Mao and D.J. Douglas, A Combined Linear Ion Trap Time–of–Flight System With Improved Performance and MS Capabilities, Rapid Communications in Mass Spectrometry, 2001, 1777–1795, vol. 15, John Wiley & Sons, Ltd.

M.A.N. Razvi, X.Z. Chu, R. Alheit, G. Werth and R. Blumel, Fractional Frequency Collective Parametric Resonances of an Ion Cloud in a Paul Trap, Physical Review A, Jul. 1998, R34–R37, vol. 58, The American Physical Society.

P.H. Dawson and N.R. Whetten, Non–Linear Resonances in Quadrupole Mass Spectrometers Due to Imperfect Fields, International Journal of Mass Spectrometry and Ion Physics, 1969, 1–12, vol. 3, Elsevier Publishing Company.

P.H. Dawson, Ion Optical Properties of Quadrupole Mass Filters, Advances in Electronics and Electron Physics, 1980, 153–208, vol. 53, Academic Press, Inc.

M. Sudakov, N. Konenkov, D.J. Douglas and T. Glebova, Excitation Frequencies of Ions Confined in a Quadrupole Field With Quadrupole Excitation, American Society for Mass Spectrometry, 2000, 10–18, Vol. 11, Elsevier Science Inc.

D.J. Douglas, and J.B. French, Collisional Focusing Effects in Radio Frequency Quadrupoles, American Society for Mass Spectrometry, 1992, 398–408, vol. 3.

M. Sudakov, Effective Potential and the Ion Axial Beat Motion Near the Boundary of the First Stable Region in a Nonlinear Ion Trap, International Journal of Mass Spectrometry, 2001, 27–43, vol. 206, Elsevier Science B.V.

B.A. Collings and D.J. Douglas, Observation of Higher Order Quadrupole Excitation Frequencies in a Linear Ion Trap, Journal of The American Society for Mass Spectrometry, Nov. 2000, 1016–1022, vol. 11, Elsevier Science Inc.

D.J. Douglas and N.V. Konenkov, Influence of the 6th and 10th Spatial Harmonics on the Peak Shape of a Quadrupole Mass Filter With Round Rods, Rapid Communications in Mass Spectrometry, 2002, 1425–1431, vol. 16, Wiley InterScience.

P.H. Dawson ed., Quadrupole Mass Spectrometry and its Applications, American Vacuum Society Classics, 1976, Elsevier Publishing Company, Amsterdam and 1995 by the American Institute of Physics, 19–23 and 70.

Raymond E. March and Richard J. Hughes, Quadrupole Storage Mass Spectrometry, The Quadrupole Mass Filter, 1989, 41, John Wiley and Sons, Toronto.

L. Landau and E.M. Lifshitz, Mechanics, Third Edition, 1966, 80–87, vol. 1, Pergamon Press, Oxford.

Raymond E. March and Frank A. Londry, Theory of Quadrupole Mass Spectrometry, Practical Aspects of Mass Spectrometry, J.F.J. Todd and R.E. Mar. ed., 1995, Chapter 2, CRC Press, Boca Raton.

J. Franzen, R.H. Gabling, M. Schubert and Y. Wang, Nonlinear Ion Traps, Practical Aspects of Mass Spectrometry, J.F. J. Todd and R.E. Mar. ed., 1995, Chapter 3, CRC Press, Boca Raton.

Jodie V. Johnson, Randall Pedder, Richard Yost, The Stretched Quadrupole Ion Trap: Implications for the Mathieu $a_u$ and $q_u$ Parameters and Experimental Mapping of the Stability Diagram, Rapid Communications in Mass Spectrometry, 1992, vol. 6, 670.

Y. Wang and J. Franzen, The Non–Linear Resonance QUISTOR Part 1, Potential Distribution in Hyperboloidal QUISTORs, International Journal of Mass Spectrometry and Ion Processes, 1992, vol. 112, 167.

Y. Wang, J. Franzen, K.P. Wanczek, The Non–Linear Resonance Ion Trap. Part 2, A General Theoretical Analysis, International Journal of Mass Spectrometry and Ion Processes, 1993, Vol. 124, 125.

Y. Wang, J. Franzen, The Nonlinear Ion Trap. Part 3, Multipole Components in Three Types of Practical Ion Trap, International Journal of Mass Spectrometry and Ion Processes, 1994, vol. 132, 155.

J. Franzen, The Non–Linear Ion Trap. Part 4, Mass Selective Instability Scan With Multipole Superposition, International Journal of Mass Spectrometry and Ion Processes, 1993, vol. 125, 165.

J. Franzen, The Non–Linear Ion Trap. Part 5, Nature of Non–Linear Resonances and Resonant Ion Ejection International Journal of Mass Spectrometry and Ion Processes, 1994, vol. 130, 15.

J. Franzen, Simulation Study of an Ion Cage With Superimposed Multipole Fields, International Journal of Mass Spectrometry and Ion Processes, 1991, vol. 106, 63.

M. Splendore, F.A. Londry, R.E. March, R.J.S. Morrison, P. Perrier, J. André, A Simulation Study of Ion Kinetic Energies During Resonant Excitation in a Stretched Ion Trap, International Journal of Mass Spectrometry and Ion Processes, 1996, 11–29, vol. 156, Elsevier Science B.V.

S. Sevugarajan, A.G. Menon, Field Imperfection Induced Axial Secular Frequency Shifts in Nonlinear Ion Traps, International Journal of Mass Spectrometry, 1999, 53–61, vol. 189, Elsevier Science B.V.

S. Sevugarajan, A.G. Menon, Frequency Perturbation in Nonlinear Paul Traps: A Simulation Study of the Effect of Geometric Aberration, Space Charge, Dipolar Excitation, and Damping On Ion Axial Secular Frequency. International Journal of Mass Spectrometry, 2000, 263–278, vol. 197, Elsevier Science B.V.

S. Sevugarajan, A.G. Menon, A Simulation Study of Coupled Secular Oscillations in Nonlinear Paul Trap Mass Spectrometers, International Journal of Mass Spectrometry, 2001, 209–226, vol. 209, Elsevier Science B.V.

S. Sevugarajan, A.G. Menon, Transition Curves and iso–$\beta_u$ Lines in Nonlinear Paul Traps, International Journal of Mass Spectrometry, 2002, 181–196, vol. 218, Elsevier Science B.V.

Loboda, Alexander, Novel Linac II Electrode Geometry for Creating an Axial Field in a Multipole Ion Guide, Eur. J. Mass. Spectrum. 6, Web Publication Apr. 20, 2001, pp. 531–536.

J. Schulte et al., Nonlinear Field Effects in Quadrupole Mass Filters, Review of Scientific instruments, American Institute of Physics, Sep. 1999, 3566–3571, vol. 70, No. 9.

AXIAL EJECTION WITH IMPROVED GEOMETRY FOR GENERATING A TWO-DIMENSIONAL SUBSTANTIALLY QUADRUPOLE FIELD

RELATED APPLICATION

This application is a continuation-in-part of U.S. patent application Ser. No. 10/211,238, filed Aug. 5, 2002.

FIELD OF THE INVENTION

This invention relates in general to quadrupole fields, and more particularly to quadrupole electrode systems for generating an improved quadrupole field for use in mass spectrometers.

BACKGROUND OF THE INVENTION

The use of quadrupole electrode systems in mass spectrometers is known. For example, U.S. Pat. No. 2,939,952 (Paul et. al.) describes a quadrupole electrode system in which four rods surround and extend parallel to a central axis. Opposite rods are coupled together and brought out to one of two common terminals. Most commonly, an electric potential V(t)=+(U−V cosΩt) is then applied between one of these terminals and ground and an electric potential V(t)=−(U−V cosΩt) is applied between the other terminal and ground. In these formulae, U is the DC voltage, pole to ground, and V is the zero to peak radio frequency (RF) voltage, pole to ground.

In constructing a linear quadrupole, the field may be distorted so that it is not an ideal quadrupole field. For example round rods are often used to approximate the ideal hyperbolic shaped rods required to produce a perfect quadrupole field. The calculation of the potential in a quadrupole system with round rods can be performed by the method of equivalent charges—see, for example, Douglas et al., *Russian Journal of Technical Physics,* 1999, Vol. 69, 96–101. When presented as a series of harmonic amplitudes $A_0$, $A_1$, $A_2$ . . . $A_n$, the potential in a linear quadrupole can be expressed as follows:

$$\phi(x, y, z, t) = V(t)\times\phi(x, y) = V(t)\sum_n \phi_n(x, y) \tag{1}$$

Field harmonics $\phi_n$, which describe the variation of the potential in the X and Y directions, can be expressed as follows:

$$\phi_n(x, y) = \mathrm{Real}\left[A_n\left(\frac{x+iy}{r_0}\right)^n\right] \tag{2}$$

where Real [(f(x+iy)] is the real part of the complex function f(x+iy).

For example:

$$\phi_0(x, y) = A_0\mathrm{Real}\left[\left(\frac{x+iy}{r_0}\right)^0\right] = A_0 \quad \text{Constant potential} \tag{3}$$

$$\phi_2(x, y) = A_2\mathrm{Real}\left[\left(\frac{x+iy}{r_0}\right)^2\right] = A_2\left(\frac{x^2-y^2}{r_0^2}\right) \quad \text{Quadrupole} \tag{4}$$

$$\phi_4(x, y) = A_4\mathrm{Real}\left[\left(\frac{x+iy}{r_0}\right)^4\right] = A_4\left(\frac{x^4-6x^2y^2+y^4}{r_0^4}\right) \quad \text{Octopole} \tag{5}$$

-continued $$\phi_6(x, y) = A_6\mathrm{Real}\left[\left(\frac{x+iy}{r_0}\right)^6\right] = A_6\left(\frac{x^6-15x^4y^2+15x^2y^4-y^6}{r_0^6}\right) \quad \text{Dodecapole} \tag{5.1}$$

$$\phi_8(x, y) = A_8\mathrm{Real}\left[\left(\frac{x+iy}{r_0}\right)^8\right] = A_8\left(\frac{x^8-28x^6y^2+70x^4y^4-28x^2y^6+y^8}{r_0^8}\right) \quad \text{Hexadecapole} \tag{5.2}$$

In these definitions, the X direction corresponds to the direction towards an electrode in which the quadrupole potential $A_2$ increases from zero to become more positive when V(t) is positive.

In the series of harmonic amplitudes, the cases in which the odd field harmonics, having amplitudes $A_1$,$A_3$,$A_5$ . . . , are each zero due to the symmetry of the applied potentials and electrodes are considered here (aside from very small contributions from the odd field harmonics due to instrumentation and measurement errors). Accordingly, one is left with the even field harmonics having amplitudes $A_0$,$A_2$, $A_4$ . . . As shown above, $A_0$ is the constant potential (i.e. independent of X and Y), $A_2$ is the quadrupole component of the field, $A_4$ is the octopole component of the field, and there are still higher order components of the field, although in a practical quadrupole the amplitudes of the higher order components are typically small compared to the amplitude of the quadrupole term.

In a quadrupole mass filter, ions are injected into the field along the axis of the quadrupole. In general, the field imparts complex trajectories to these ions, which trajectories can be described as either stable or unstable. For a trajectory to be stable, the amplitude of the ion motion in the planes normal to the axis of the quadrupole must remain less than the distance from the axis to the rods ($r_0$). Ions with stable trajectories will travel along the axis of the quadrupole electrode system and may be transmitted from the quadrupole to another processing stage or to a detection device. Ions with unstable trajectories will collide with a rod of the quadrupole electrode system and will not be transmitted.

The motion of a particular ion is controlled by the Mathieu parameters a and q of the mass analyzer. For positive ions, these parameters are related to the characteristics of the potential applied from terminals to ground as follows:

$$a_x = -a_y = a = \frac{8eU}{m_{ion}\Omega^2 r_0^2} \text{ and } q_x = -q_y = q = \frac{4eV}{m_{ion}\Omega^2 r_0^2} \tag{6}$$

where e is the charge on an ion, $m_{ion}$ n is the ion mass, Ω=2πf where f is the RF frequency, U is the DC voltage from a pole to ground and V is the zero to peak RF voltage from each pole to ground. If the potentials are applied with different voltages between pole pairs and ground, U and V are ½ of the DC potential and the zero to peak AC potential respectively between the rod pairs. Combinations of a and q which give stable ion motion in both the x and y directions are usually shown on a stability diagram.

With operation as a mass filter, the pressure in the quadrupole is kept relatively low in order to prevent loss of ions by scattering by the background gas. Typically the pressure is less than $5\times10^{-4}$ torr and preferably less than $5\times10^{-5}$ torr. More generally quadrupole mass filters are usually operated in the pressure range $1\times10^{-6}$ torr to $5\times10^{-4}$ torr. Lower pressures can be used, but the reduction in scattering losses below $1\times10^{-6}$ torr are usually negligible.

As well, when linear quadrupoles are operated as a mass filter the DC and AC voltages (U and V) are adjusted to place ions of one particular mass to charge ratio just within the tip of a stability region, as described. Normally, ions are continuously introduced at the entrance end of the quadrupole and continuously detected at the exit end. Ions are not normally confined within the quadrupole by stopping potentials at the entrance and exit. An exception to this is shown in the papers Ma'an H. Amad and R. S. Houk, "High Resolution Mass Spectrometry With a Multiple Pass Quadrupole Mass Analyzer", *Analytical Chemistry,* 1998, Vol. 70, 4885–4889, and Ma'an H. Amad and R. S. Houk, "Mass Resolution of 11,000 to 22,000 With a Multiple Pass Quadrupole Mass Analyzer", *Journal of the American Society for Mass Spectrometry,* 2000, Vol. 11, 407–415. These papers describe experiments where ions were reflected from electrodes at the entrance and exit of the quadrupole to give multiple passes through the quadrupole to improve the resolution. Nevertheless, the quadrupole was still operated at low pressure, although this pressure is not stated in these papers, and with the DC and AC voltages adjusted to place the ions of interest at the tip of the first stability region.

In contrast, when linear quadrupoles are operated as ion traps, the DC and AC voltages are normally adjusted so that ions of a broad range of mass to charge ratios are confined. Ions are not continuously introduced and extracted. Instead, ions are first injected into the trap (or created in the trap by fragmentation of other ions, as described below, or by ionization of neutrals). Ions are then processed in the trap, and are subsequently removed from the trap by a mass selective scan, or allowed to leave the trap for additional processing or mass analysis, as described. Ion traps can be operated at much higher pressures than quadrupole mass filters, for example $3\times10^{-3}$ torr of helium (J. C. Schwartz, M. W. Senko, J. E. P. Syka, "A Two-Dimensional Quadrupole Ion Trap Mass Spectrometer", *Journal of the American Society for Mass Spectrometry,* 2002, Vol. 13, 659–669; published online Apr. 26, 2002 by Elsevier Science Inc.) or up to $7\times10^{-3}$ torr of nitrogen (Jennifer Campbell, B. A. Collings and D. J. Douglas, "A New Linear Ion Trap Time of Flight System With Tandem Mass Spectrometry Capabilities", *Rapid Communications in Mass Spectrometry,* 1998, Vol. 12, 1463–1474; B. A. Collings, J. M. Campbell, Dunmin Mao and D. J. Douglas, "A Combined Linear Ion Trap Time-of-Flight System With Improved Performance and MS″ Capabilities", *Rapid Communications in Mass Spectrometry,* 2001, Vol. 15, 1777–1795. Typically, ion traps operate at pressures of $10^{-1}$ torr or less, and preferably in the range $10^{-5}$ to $10^{-2}$ torr. More preferably ion traps operate in the pressure range $10^{-4}$ to $10^{-2}$ torr. However ion traps can still be operated at much lower pressures for specialized applications (e.g. $10^{-9}$ mbar (1 mbar=0.75 torr) M. A. N. Razvi, X. Y. Chu, R. Alheit, G. Werth and R. Blumel, "Fractional Frequency Collective Parametric Resonances of an Ion Cloud in a Paul Trap", *Physical Review* A, 1998, Vol. 58, R34–R37). For operation at higher pressures, gas can flow into the trap from a higher pressure source region or can be added to the trap through a separate gas supply and inlet.

Recently, there has been interest in performing mass selective scans by ejecting ions at the stability boundary of a two-dimensional quadrupole ion trap (see, for example, U.S. Pat. No. 5,420,425; J. C. Schwartz, M. W. Senko, J. E. P. Syka, "A Two-Dimensional Quadrupole Ion Trap Mass Spectrometer", *Journal of the American Society for Mass Spectrometry,* 2002, Vol. 13, 659–669; published online Apr. 26, 2002 by Elsevier Science Inc.). In the two-dimensional ion trap, ions are confined radially by a two-dimensional quadrupole field and are confined axially by stopping potentials applied to electrodes at the ends of the trap. Ions are ejected through an aperture or apertures in a rod or rods of a rod set to an external detector by increasing the RF voltage so that ions reach their stability limit and are ejected to produce a mass spectrum.

Ions can also be ejected through an aperture or apertures in a rod or rods by applying an auxiliary or supplemental excitation voltage to the rods to resonantly excite ions at their frequencies of motion, as described below. This can be used to eject ions at a particular q value, for example q=0.8. By adjusting the trapping RF voltage, ions of different mass to charge ratio are brought into resonance with the excitation voltage and are ejected to produce a mass spectrum. Alternatively the excitation frequency can be changed to eject ions of different masses. Most generally the frequencies, amplitudes and waveforms of the excitation and trapping voltages can be controlled to eject ions through a rod in order to produce a mass spectrum.

The efficacy of a mass filter used for mass analysis depends in part on its ability to retain ions of the desired mass to charge ratio, while discarding the rest. This, in turn, depends on the quadrupole electrode system (1) reliably imparting stable trajectories to selected ions and also (2) reliably imparting unstable trajectories to unselected ions. Both of these factors can be improved by controlling the speed with which ions are ejected as they approach the stability boundary in a mass scan.

Mass spectrometry (MS) will often involve the fragmentation of ions and the subsequent mass analysis of the fragments (tandem mass spectrometry). Frequently, selection of ions of a specific mass to charge ratio or ratios is used prior to ion fragmentation caused by Collision Induced Dissociation with a collision gas (CID) or other means (for example, by collisions with surfaces or by photo dissociation with lasers). This facilitates identification of the resulting fragment ions as having been produced from fragmentation of a particular precursor ion. In a triple quadrupole mass spectrometer system, ions are mass selected with a quadrupole mass filter, collide with gas in an ion guide, and mass analysis of the resulting fragment ions takes place in an additional quadrupole mass filter. The ion guide is usually operated with radio frequency only voltages between the electrodes to confine ions of a broad range of mass to charge ratios in the directions transverse to the ion guide axis, while transmitting the ions to the downstream quadrupole mass analyzer. In a three-dimensional ion trap mass spectrometer, ions are confined by a three-dimensional quadrupole field, a precursor ion is isolated by resonantly ejecting all other ions or by other means, the precursor ion is excited resonantly or by other means in the presence of a collision gas and fragment ions formed in the trap are subsequently ejected to generate a mass spectrum of fragment ions. Tandem mass spectrometry can also be performed with ions confined in a linear quadrupole ion trap. The quadrupole is operated with radio frequency voltages between the electrodes to confine ions of a broad range of mass to charge ratios. A precursor ion can then be isolated by resonant ejection of unwanted ions or other methods. The precursor ion is then resonantly excited in the presence of a collision gas or excited by other means, and fragment ions are then mass analyzed. The mass analysis can be done by allowing ions to leave the linear ion trap to enter another mass analyzer such as a time-of-flight mass analyzer (Jennifer Campbell, B. A. Collings and D. J.

Douglas, "A New Linear Ion Trap Time of Flight System With Tandem Mass Spectrometry Capabilities", *Rapid Communications in Mass Spectrometry,* 1998, Vol. 12,1463–1474; B. A. Collings, J. M. Campbell, Dunmin Mao and D. J. Douglas, "A Combined Linear Ion Trap Time-of-Flight System With Improved Performance and MS$^n$ Capabilities", *Rapid Communications in Mass Spectrometry,* 2001, Vol. 15, 1777–1795) or by ejecting the ions through an aperture or apertures in a rod or rods to an external ion detector (M. E. Bier and John E. P. Syka, U.S. Pat. No. 5,420,425, May 30, 1995; J. C. Schwartz, M. W. Senko, J. E. P. Syka, "A Two-Dimensional Quadrupole Ion Trap Mass Spectrometer", *Journal of the American Society for Mass Spectrometry,* 2002, Vol. 13, 659–669; published online Apr. 26, 2002 by Elsevier Science Inc.). Alternatively, fragment ions can be ejected axially in a mass selective manner (J. Hager, "A New Linear Ion Trap Mass Spectrometer", *Rapid Communications in Mass Spectrometry,* 2002, Vol. 16, 512 and U.S. Pat. No. 6,177,668, issued Jan. 23, 2001 to MDS Inc.). The term MS$^n$ has come to mean a mass selection step followed by an ion fragmentation step, followed by further ion selection, ion fragmentation and mass analysis steps, for a total of n mass analysis steps.

Similar to mass analysis, CID is assisted by moving ions through a radio frequency field, which confines the ions in two or three dimensions. However, unlike conventional mass analysis in a linear quadrupole mass filter, which uses fields to impart stable trajectories to ions having the selected mass to charge ratio and unstable trajectories to ions having unselected mass to charge ratios, quadrupole fields when used with CID are operated to provide stable but oscillatory trajectories to ions of a broad range of mass to charge ratios. In two-dimensional ion traps, resonant excitation of this motion can be used to fragment the oscillating ions. However, there is a trade off in the oscillatory trajectories that are imparted to the ions. If a very low amplitude motion is imparted to the ions, then little fragmentation will occur. However, if a larger amplitude oscillation is provided, then more fragmentation will occur, but some of the ions, if the oscillation amplitude is sufficiently large, will have unstable trajectories and will be lost. There is a competition between ion fragmentation and ion ejection. Thus, both the trapping and excitation fields must be carefully selected to impart sufficient energy to the ions to induce fragmentation, while not imparting so much energy as to lose the ions.

Accordingly, there is a continuing need to improve the two-dimensional quadrupole fields for mass filters and ion traps, both in terms of ion selection, and in terms of ion fragmentation. Specifically, for ion fragmentation in a linear ion trap, a quadrupole electrode system that provides a field that provides an oscillatory motion that is energetic enough to induce fragmentation while stable enough to prevent ion ejection, is desirable. For ion selection whether in a mass filter or in an ion trap by ejection at the stability boundary or by resonant excitation, a quadrupole electrode system that provides a field that causes ions to be ejected more rapidly, thus allowing for faster scan speeds and higher mass resolution, is also desirable.

SUMMARY OF THE INVENTION

An object of a first aspect of the present invention is to provide an improved method of operating a mass spectrometer.

In accordance with this first aspect of the present invention, there is provided a method of operating a mass spectrometer having an elongated rod set, the rod set having an entrance end and an exit end and a longitudinal axis. The method comprises: (a) admitting ions into the entrance end of the rod set, (b) trapping at least some of the ions in the rod set by producing a barrier field at an exit member adjacent to the exit end of the rod set and by producing an RF field between the rods of the rod set adjacent at least the exit end of the rod set, (c) the RF and barrier fields interacting in an extraction region adjacent to the exit end of the rod set to produce a fringing field, and (d) energizing ions in the extraction region to mass selectively eject at least some ions of a selected mass to charge ratio axially from the rod set past the barrier field. The RF field is a two-dimensional substantially quadrupole field having a quadrupole harmonic with amplitude $A_2$, an octopole harmonic with amplitude $A_4$, and a hexadecapole harmonic with amplitude $A_8$, wherein $A_8$ is less than $A_4$, and $A_4$ is greater than 0.1% of $A_2$.

An object of a second aspect of the present invention is to provide an improved a mass spectrometer system.

In accordance with this second aspect of the present invention, there is provided a mass spectrometer system comprising: (a) an ion source; (b) a main rod set having an entrance end for admitting ions from the ion source and an exit end for ejecting ions traversing a longitudinal axis of the main rod set; (c) an exit member adjacent to the exit end of the main rod set; (d) power supply means coupled to the main rod set and the exit member for producing an RF field between rods of the main rod set and a barrier field at the exit end, whereby in use (i) at least some of the ions admitted in the main rod set are trapped within the rods and (ii) the interaction of the RF and barrier fields produces a fringing field adjacent to the exit end, and (e) an AC voltage source coupled to one of: the rods of the main rod set; and the exit member, whereby the AC voltage mass dependently and axially ejects ions trapped in the vicinity of the fringing field from the exit end. The RF field is a two-dimensional substantially quadrupole field having a quadrupole harmonic with amplitude $A_2$, an octopole harmonic with amplitude $A_4$, and a hexadecapole harmonic with amplitude $A_8$, wherein $A_8$ is less than $A_4$, and $A_4$ is greater than 0.1% of $A_2$.

BRIEF DESCRIPTION OF THE DRAWINGS

A detailed description of the preferred embodiments is provided herein below with reference to the following drawings, in which.

DETAILED DESCRIPTION OF PREFERRED EMBODIMENTS OF THE INVENTION

Figure 1:
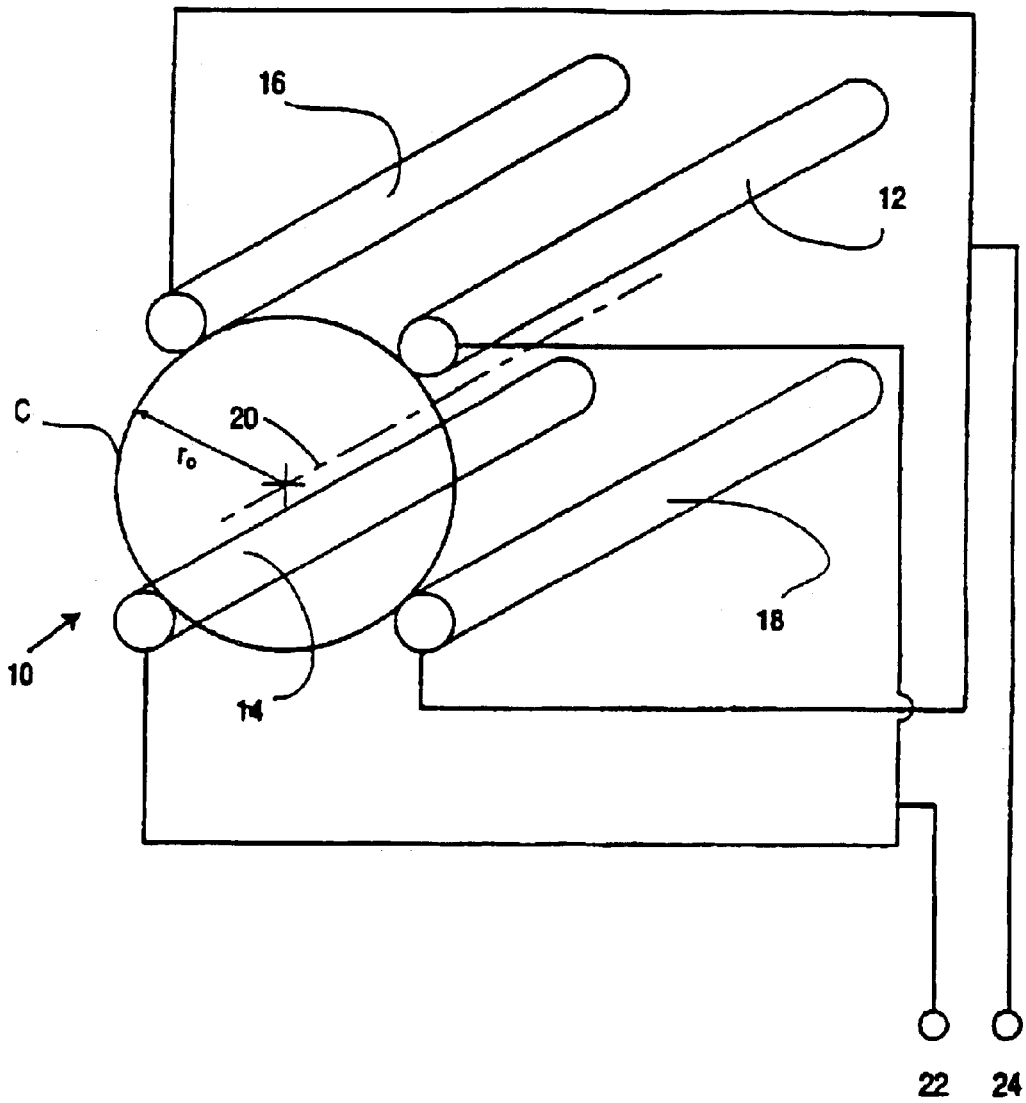
FIG. 1, in a schematic perspective view, illustrates a set of quadrupole rods.

Referring to FIG. 1, there is illustrated a quadrupole rod set 10 according to the prior art. Quadrupole rod set 10 comprises rods 12, 14, 16 and 18. Rods 12, 14, 16 and 18 are arranged symmetrically around axis 20 such that the rods have an inscribed a circle C having a radius $r_0$. The cross sections of rods 12, 14, 16 and 18 are ideally hyperbolic and of infinite extent to produce an ideal quadrupole field, although rods of circular cross-section are commonly used. As is conventional, opposite rods 12 and 14 are coupled together and brought out to a terminal 22 and opposite rods 16 and 18 are coupled together and brought out to a terminal 24. An electrical potential V(t)=+(U−V cosΩt) is applied between terminal 22 and ground and an electrical potential V(t)=−(U−V cosΩt) is applied between terminal 24 and ground. When operating conventionally as a mass filter, as described below, for mass resolution, the potential applied has both a DC and AC component. For operation as a mass filter or an ion trap, the potential applied is at least partially-AC. That is, an AC potential will always be applied, while a DC potential will often, but not always, be applied. The AC components will normally be in the RF range, typically about 1 MHz. As is known, in some cases just an RF voltage is applied. The rod sets to which the positive DC potential is coupled may be referred to as the positive rods and those to which the negative DC potential is coupled may be referred to as the negative rods.

As described above, the motion of a particular ion is controlled by the Mathieu parameters a and q of the mass analyzer. These parameters are related to the characteristics of the potential applied from terminals 22 and 24 to ground as follows:

$$a_x = -a_y = a = \frac{8eU}{m_{ion}\Omega^2 r_0^2} \text{ and } q_x = -q_y = q = \frac{4eV}{m_{ion}\Omega^2 r_0^2} \tag{6}$$

where e is the charge on an ion, $m_{ion}$ is the ion mass, Ω=2πf where f is the RF frequency, U is the DC voltage from a pole to ground and V is the zero to peak RF voltage from each pole to ground. Combinations of a and q which give stable ion motion in both the X and Y directions are shown on the stability diagram of FIG. 2. The notation of FIG. 2 for the regions of stability is taken from P. H. Dawson ed., "Quadrupole Mass Spectrometry and Its Applications", *American Vacuum Society Classics,* 1976, Elsevier, Amsterdam, 19–23 and 70. The "first" stability region refers to the region near (a,q)=(0.2, 0.7), the "second" stability region refers to the region near (a,q)=(0.02, 7.55) and the "third" stability region refers to the region near (a,q)=(3,3). It is important to note that there are many regions of stability (in fact an unlimited number). Selection of the desired stability regions, and selected tips or operating points in each region, will depend on the intended application.

Ion motion in a direction u in a quadrupole field can be described by the equation $$u(\xi) = A\sum_{n=-\infty}^{\infty} C_{2n}\cos[(2n+\beta)\xi] + B\sum_{n=-\infty}^{\infty} C_{2n}\sin[(2n+\beta)\xi] \tag{7}$$

where $$\xi = \frac{\Omega t}{2}$$

and t is time, $C_{2n}$ depend on the values of a and q, and A and B depend on the ion initial position and velocity (see, for example, R. E. March and R. J. Hughes, *Quadrupole Storage Mass Spectrometry*, John Wiley and Sons, Toronto, 1989, page 41). The value of β determines the frequencies of ion oscillation, and β is a function of the a and q values (P. H. Dawson ed., *Quadrupole Mass Spectrometry and Its Applications*, Elsevier, Amsterdam, 1976, page 70). From equation 7, the angular frequencies of ion motion in the X ($\omega_x$) and Y ($\omega_y$) directions in a two-dimensional quadrupole field are given by $$\omega_x = (2n + \beta_x)\frac{\Omega}{2} \tag{8}$$

$$\omega_y = (2n + \beta_y)\frac{\Omega}{2} \tag{9}$$

where n=0, ±1, ±2, ±3 . . . , $0 \leqq \beta_x \leqq 1$, $0 \leqq \beta_y \leqq 1$, and $\beta_x$ and $\beta_y$ are determined by the Mathieu parameters a and q for motion in the x and y directions respectively (equation 6).

When higher field harmonics are present in a linear quadrupole, so called nonlinear resonances may occur. As shown for example by Dawson and Whetton (P. H. Dawson and N. R. Whetton, "Non-Linear Resonances in Quadrupole Mass Spectrometers Due to Imperfect Fields", *International Journal of Mass Spectrometry and Ion Physics,* 1969, Vol. 3, 1–12) nonlinear resonances occur when $$\frac{\beta_x}{2}K + (N - K)\frac{\beta_y}{2} = 1 \tag{10}$$

where N is the order of the field harmonic and K is an integer and can have the values N, N–2, N–4 . . . Combinations of $\beta_x$ and $\beta_y$ that produce nonlinear resonances form lines on the stability diagram. When a nonlinear resonance occurs, an ion, which would otherwise have stable motion, has unstable motion and can be lost from the quadrupole field. These effects are expected to be more severe when a linear quadrupole is used as an ion trap as compared to when the linear quadrupole is used as a mass filter. When the linear quadrupole is used as an ion trap, the non-linear resonances have longer times to build up. Thus, in the past it has been believed that the levels of octopoles and other higher order multipoles present in a two-dimensional quadrupole field should be as small as possible.

We have determined, as described below, that two-dimensional quadrupole fields used in mass spectrometers can be improved, both in terms of ion selection, and in terms of ion fragmentation, by adding an octopole component to the field. The added octopole component is far larger than octopole components arising from instrumentation or measurement errors. Specifically, octopole components resulting from these errors are typically well under 0.1%. In contrast, the octopole component $A_4$ according to the present invention is typically in the range of 1 to 4% of $A_2$, and may be as high as 6% of $A_2$ or even higher. Accordingly, to realize the advantages from introducing an octopole component to a main trapping quadrupole field, it is desirable to construct an electrode system in which a certain level of octopole field imperfection is deliberately introduced into the main trapping quadrupole field, while limiting the introduction of other field imperfections. An octopole field can be added by constructing an electrode system, which is different in the X and Y directions.

Figure 3:
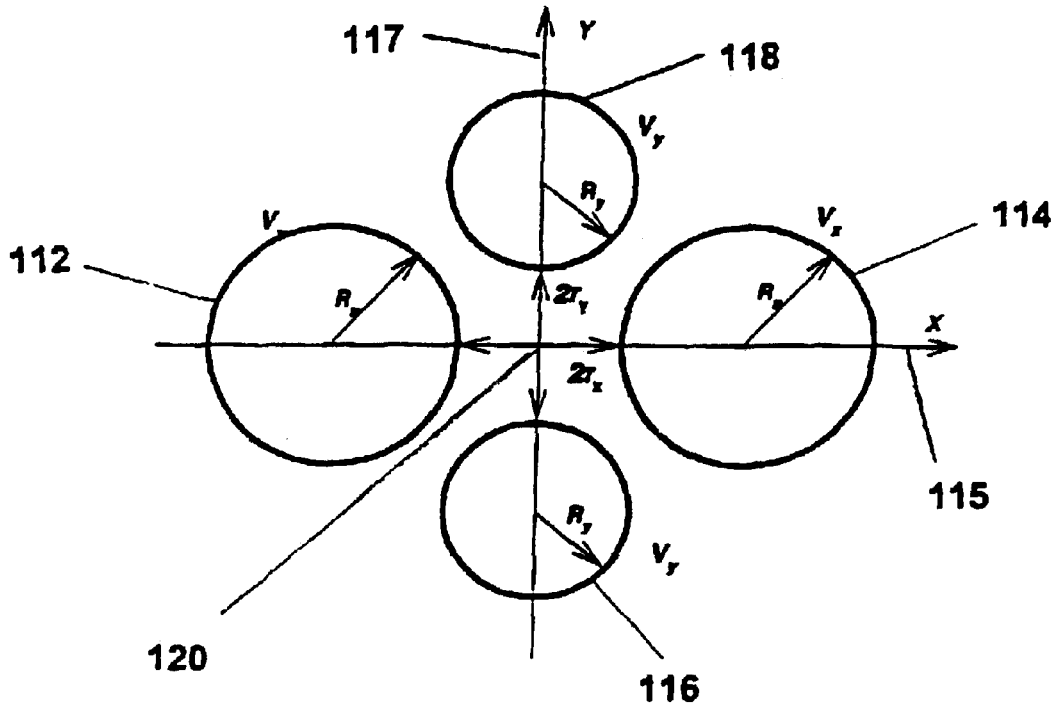
FIG. 3 is a sectional view of a set of quadrupole rods in which the X and Y rods are of different diameters.

Methods to deliberately introduce a substantial octopole component to a linear quadrupole while at the same time minimizing contributions from other higher harmonics have not been described. P. H. Dawson, in "Optical Properties of Quadrupole Mass Filters", *Advances in Electronics and Electron Physics,* 1980, Vol. 53, 153–208, at 195, showed that moving opposite rods outward will add an octopole component to the field; however, the inventors have calculated that this also adds to the potential 12 ($A_6$) and 16 ($A_8$) pole terms of magnitude similar to the octopole term. The inventors have found a method to add an octopole term to the potential while keeping other harmonics much smaller. Quadrupole electrode systems in accordance with different embodiments of the invention are described below. Referring to FIG. 3, there is illustrated in a sectional view, a set of quadrupole rods. The set of quadrupole rods includes X rods 112 and 114, Y rods 116 and 118, and has quadrupole axis 120. FIG. 3 introduces terminology used in describing both of the below embodiments of the invention. Specifically, $V_y$ is the voltage provided to Y rods 116 and 118, $R_y$ is the radius of these Y rods 116 and 118, and $r_y$ is the radial distance of the Y rods 116 and 118 from quadrupole axis 120.

Similarly, $V_x$ is the voltage provided to X rods 112 and 114, $R_x$ is the radius of these X rods 112, 114 and $r_x$ is the radial distance of these X rods 112 and 114 from quadrupole axis 120. It will be apparent to those of skill in the art that while $R_y$ is shown to be less than $R_x$ in FIG. 3, this is not necessarily so. Specifically, these terms are simply introduced to show how geometric variations can be introduced to the quadrupole electrode system in order to have the desired effects on the field generated.

Figure 4:
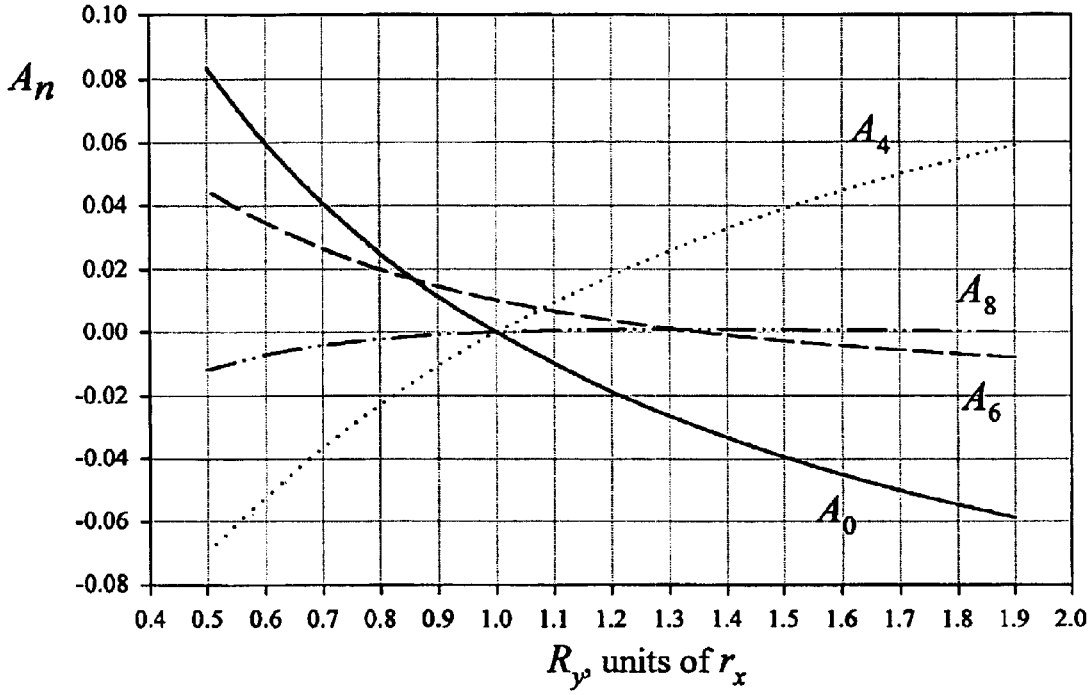
FIG. 4 is a graph of field harmonic amplitudes as a function of the radius of the Y rod relative to the spacing of the X rod from the quadrupole axis.

The inventors have determined that an octopole component may be added to a quadrupole field by making the diameters of the Y rods substantially different from the diameters of the X rods. In order to investigate the fields in such systems, one takes $r_y=R_x=r_x$. The Y rod radius ($R_y$) is then changed. In this case, the field harmonic amplitudes calculated are shown in FIG. 4. For this calculation, the rods are in a case of radius $R_g=8r_x$.

The potential calculation expressed in the field harmonic amplitudes of FIG. 4 shows that this method is useful to create a quadrupole field with a substantial added octopole component. When the Y rods 116 and 118 have diameters greater than the X rods 112 and 114, an octopole field is present and all other higher harmonics have comparatively small amplitudes. The quadrupole component stays almost unchanged (data for the quadrupole component are not shown).

Effective quadrupole electrode systems can be designed merely by increasing the dimensions of the Y rods relative to the X rods, as described above. However, with this method, a substantial constant potential is produced. Its value, $A_0$, is almost equal to the amplitude of the octopole field, $A_4$. While effective quadrupole electrode systems can have substantial constant potentials in the fields generated, preferably, the constant potential should be kept as small as possible. The constant potential arises in this case because the bigger rods influence the axis potential when they are placed at the same distance as the smaller rods. The potential on the axis can be removed in two different ways: 1) increasing the distance from the center 120 to the larger rods and 2) by a voltage misbalance between the X and the Y rods (usually the voltage of the Y rods is equal to the voltage of the X rods, but of opposite sign). A discussion of these two methods follows.

1. Increasing the Distance From the Central Axis 120 to Y Rods 116 and 118

Figure 5:
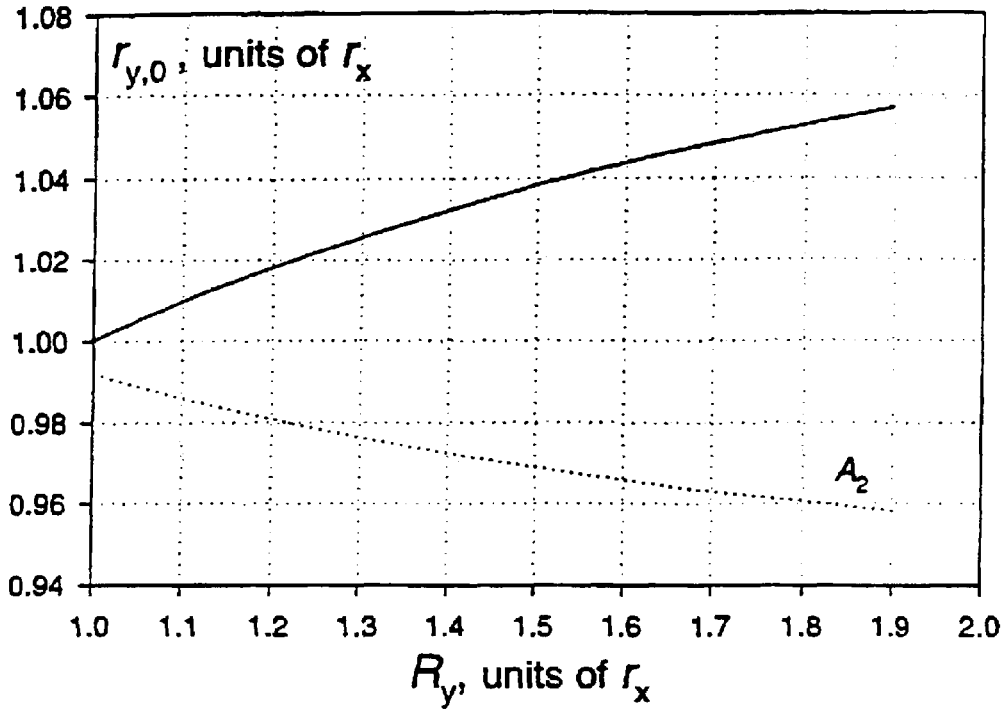
FIG. 5 is a graph plotting spacing of the Y rods from the quadrupole axis, which is calculated to yield a zero axis potential, against the radius of the Y rods.
Figure 6:
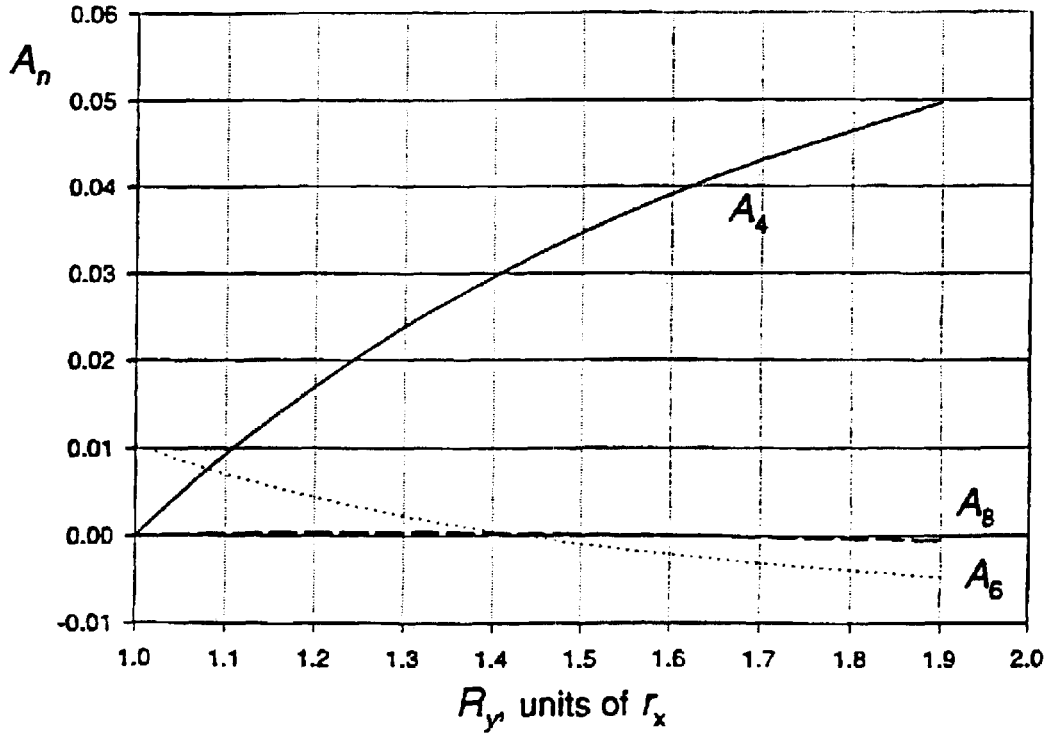
FIG. 6 is a graph plotting the quadrupole and higher order harmonic amplitudes against the diameter of the Y rods, when the spacing of the Y rods is selected to yield a zero constant potential.

In the calculation, $R_x=r_x$ as previously. One then takes some value of $R_y$ greater than $r_x$, and finds the value of $r_y$ that gives zero constant potential. This is called the "zero" Y distance from the center, $r_{y0}$. A graph of $r_{y0}$ versus $R_y$ is shown in FIG. 5. When this is done, the higher harmonics' amplitudes change somewhat and are no longer given by FIG. 4. The higher harmonic amplitudes for the case where the rods are moved out are shown in FIG. 6. The $A_2$ term is shown in FIG. 5.

Figure 7:
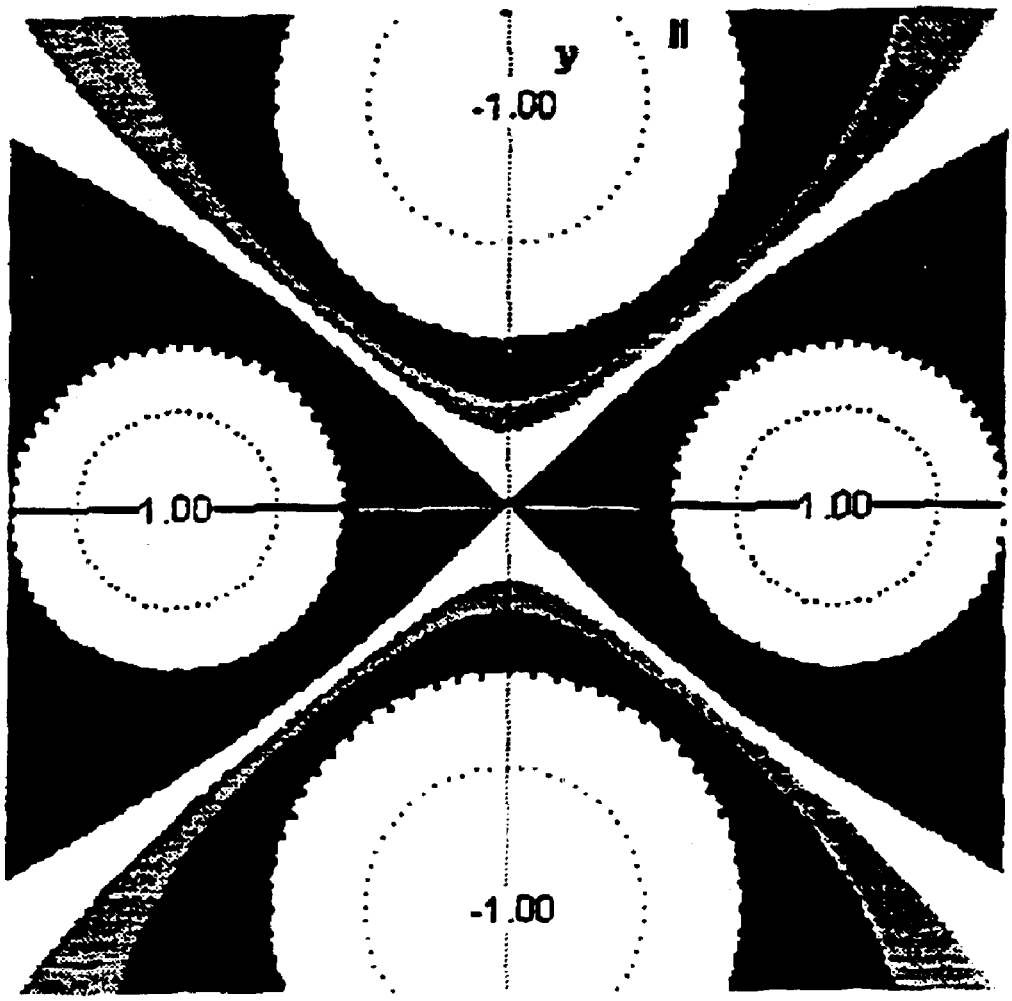
FIG. 7, in a schematic sectional view, illustrates equal potential lines where the diameter of the Y rods is optimized.

This calculation shows that it is possible to construct an electrode geometry in which the constant potential is zero, the octopole field is present in a given proportion to the quadrupole field, and other higher field harmonics have comparatively small values. When the rods have unequal distances from the center in order to make $A_0=0$, the best solution to this problem, is the point where $A_6=0$ (see FIG. 6). This is called the "optimal" electrode geometry. The value of $R_y$ at this point, $R_{y,opt}$, is close to $1.43 \cdot r_x$. Calculated harmonic amplitudes for this case are shown in Table 1. The equal potential lines are shown in FIG. 7.

TABLE 1

| Harmonic amplitudes for the case of optimal geometry: $R_x = 1.0 \cdot r_x$, $R_y = 1.43 \cdot r_x$, $r_y = 1.034 \cdot r_x$. | | | | | |
|---|---|---|---|---|---|
| $A_0$ | $A_2$ | $A_4$ | $A_6$ | $A_8$ | $A_{10}$ |
| 0.000367 | 0.970860 | 0.031114 | 0.000070 | 0.000276 | 0.0020433 |

2. Voltage Misbalance Between the X and Y Rods

An axis potential of zero may be achieved by keeping $r_x=R_x=r_y$ and adding a voltage misbalance. Usually the voltage is applied in such a way that the Y rod voltage is equal to the X rod voltage but is of the opposite sign $V_y=-V_x$. This gives an axis potential of zero in a system of 4 equal diameter rods. When the Y rods 116 and 118 have greater diameters than the X rods 112 and 114, the axis potential will be influenced by the Y rod potential. This gives a non-zero axis potential. This may be removed by a voltage misbalance. Let us assume that the sum of the voltages on the X and Y rods is equal to twice the main trapping voltage:

$$|V_x/+/V_y|=2V(t) \tag{11}$$

To achieve zero axis potential, the voltage of whichever pair of rods is larger will be somewhat lower, while the voltage of the smaller pair of rods will be somewhat higher. Call whichever pair of rods has a larger diameter, the first pair of rods, and the other pair of rods having the smaller diameters, the second pair of rods. Then the voltage of the first pair of rods will be somewhat lower: $|V_1/V(t)|=(1-\epsilon)$, while the voltage of the second pair of rods will be somewhat higher: $|V_2/V(t)|=1+\epsilon$. The value of $\epsilon$ is given by $$\epsilon=-A_0\approx A_4 \tag{12}$$

Here $A_0$ is the number given in FIG. 4. For the system of 4 rods in a free space this is an accurate result. With a quadrupole case of radius $R_g=8r_x$, as was used for the calculation presented in FIG. 4, this is very close to true. An example of the field calculation is presented in Table 2:

TABLE 2

| Harmonic amplitudes for the geometry $R_x = r_y = 1.0 \cdot r_x$, $R_y = 1.7$. | | | | | |
|---|---|---|---|---|---|
| $A_0$ | $A_2$ | $A_4$ | $A_6$ | $A_8$ | $A_{10}$ |
| With voltage misbalance $\epsilon = 0.04996$ and quadrupole case: $R_g = 8 \cdot r_x$ | | | | | |
| −0.000002 | 1.008199 | 0.049855 | −0.005697 | 0.000580 | −0.002250 |
| With voltage misbalance $\epsilon = 0.04996$ and without a quadrupole case ($R_g = \infty$) | | | | | |
| −0.000032 | 1.008195 | 0.049893 | −0.005692 | 0.000572 | −0.002252 |

TABLE 2-continued

| Harmonic amplitudes for the geometry $R_x = r_y = 1.0 \cdot r_x$, $R_y = 1.7$. | | | | | |
|---|---|---|---|---|---|
| $A_0$ | $A_2$ | $A_4$ | $A_6$ | $A_8$ | $A_{10}$ |
| Without voltage misbalance ($\epsilon = 0$) and without a quadrupole case ($R_g = \infty$) | | | | | |
| −0.049992 | 1.008195 | 0.049893 | −0.005692 | 0.000572 | −0.002252 |

The foregoing describes how to create a two-dimensional quadrupole field with a certain value of octopole harmonic in a system of 4 parallel cylinders. Preferably, $A_6$ and $A_8$ are 0 or as close to 0 as possible.

In order to produce a quadrupole field with an added octopole field (near 3%), it is useful to construct the electrodes with the geometry presented in Table 1. For higher or lower values of the octopole field, the geometry may be determined from FIGS. 4 to 6.

Ion Fragmentation

Adding an octopole component to the two-dimensional quadrupole field allows ions to be excited for longer periods of time without ejection from the field. In general, in the competition between ion ejection and ion fragmentation, this favors ion fragmentation.

When ions are excited with a dipole field, the excitation voltage requires a frequency given by equation 8 or 9. As shown in M. Sudakov, N. Konenkov, D. J. Douglas and T. Glebova, "Excitation Frequencies of Ions Confined in a Quadrupole Field With Quadrupole Excitation", *Journal of the American Society for Mass Spectrometry,* 2000, Vol. 11, 10–18, when ions are excited with a quadrupole field the excitation angular frequencies are given by $$\omega(m, k) = |m + \beta|\frac{\Omega}{K} \tag{13}$$

where K=1,2,3 . . . and m=0, ±1,±2,±3 . . . Of course, when the quadrupole field has small contributions of higher field harmonics added, the excitation fields, dipole or quadrupole, may also contain small contributions from the higher harmonics.

Figure 8A:
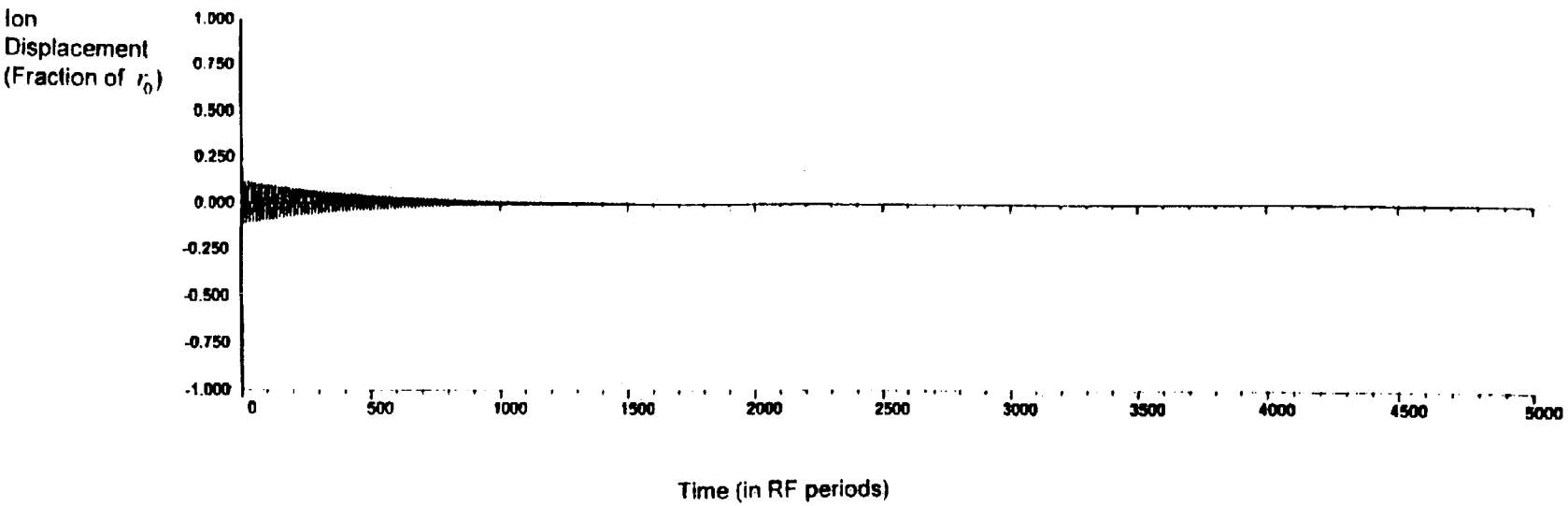
FIG. 8A is a graph plotting ion displacement, expressed as a fraction of the distance from the quadrupole axis to the rods, as a function of time in RF periods due to a selected field acting on the ion.

Referring to FIG. 8A, there is illustrated the calculated displacement of an ion as a fraction of $r_0$ against time in RF periods. The total length of time is 5000 periods. In this case, no direct current voltage is applied to the quadrupole rods (U=0), and a radio frequency voltage of V=124.29 volts is applied. The Mathieu parameters a and q are 0.00000 and 0.210300 respectively, which are in the first stability region. There is linear damping of the ion motion (i.e. there is a drag force on the ion by the gas, which is linearly proportional to the ion speed). The radio frequency is 768 kHz, $r_0$ is equal to 4.0 mm. The ion mass and charge are 612 and 1 respectively. The mass of the collision gas is 28 (nitrogen) and its temperature is 300 Kelvin. The collision cross section between the ions and gas is 200.0 $Å^2$, and the pressure of the gas is 1.75 millitorr. The initial displacement of the ion in the X direction is 0.1 $r_0$. The initial displacement of the ion in the Y direction is 0.1 $r_0$. The initial velocities of the ion in the X and Y directions are zero. The trajectory calculation is for an ideal quadrupole field with no added octopole component. There is no excitation of the ion motion in the trajectory shown in FIG. 8A.

Figure 8B:
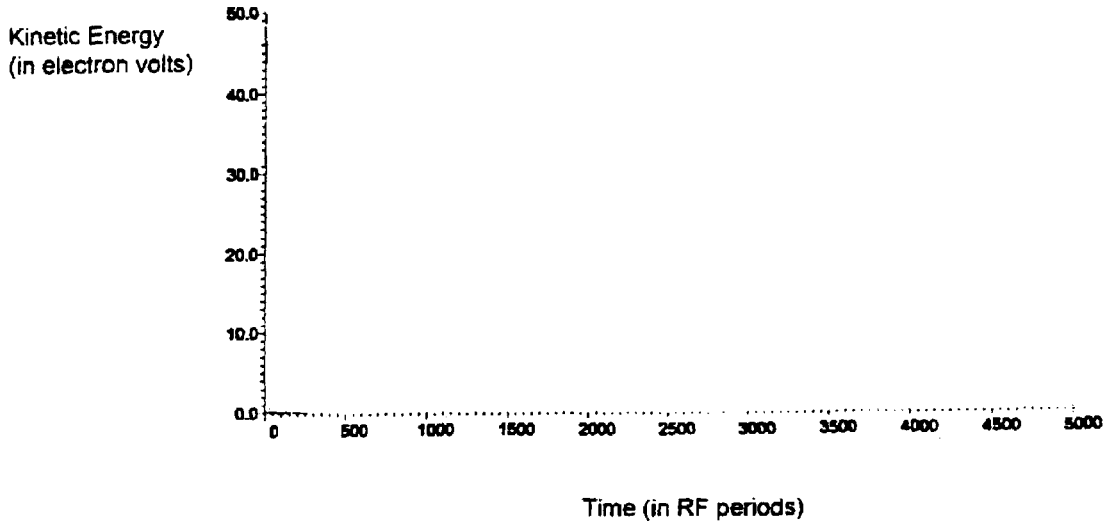
FIG. 8B is a graph plotting the kinetic energy, in electron volts, imparted to the ion of FIG. 8A over time in RF periods.
Figure 8C:
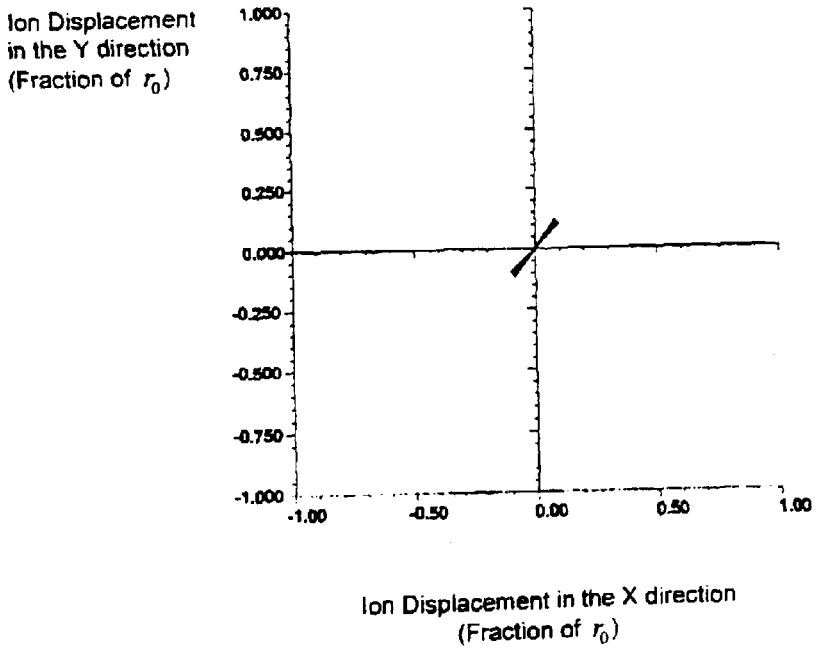
FIG. 8C is a graph plotting the displacement of the ion of FIG. 8A in the Y direction against the displacement in the X direction.

From FIG. 8A, it is apparent that when a simple quadrupole field, lacking any higher order terms, is generated by an electrode system, and when there is no excitation of ion motion, the ions generally have a declining quantity of kinetic energy. Ions move through the two-dimensional quadrupole field and lose energy in the radial and axial directions as discussed for example in D. J. Douglas and J. B. French, "Collisional Focusing Effects in Radio Frequency Quadrupoles", *Journal of the American Society for Mass Spectrometry,* 1992, Vol. 3, 398–408. As a consequence, the ions are confined and move toward the centerline of the quadrupole, and fragmentation is minimal. Referring to FIG. 8B, the kinetic energy in electron volts (eV) of the ions is very low. In fact the kinetic energy is so low that it appears to be nearly zero in FIG. 8B. As the ion oscillates in the field, the kinetic energy varies between zero and a maximum value that decreases with time. The kinetic energy averaged over each period of the ion motion decreases with time. Referring to FIG. 8C, a graph plots displacement of the ion in the Y direction against displacement of the ion in the X direction. From FIG. 8C, it can be seen that the motion of the ion is highly restricted and, for this trajectory, within a very small area in which its X and Y displacements are substantially equal. This is a consequence of the initial conditions for this single trajectory.

Figure 9A:
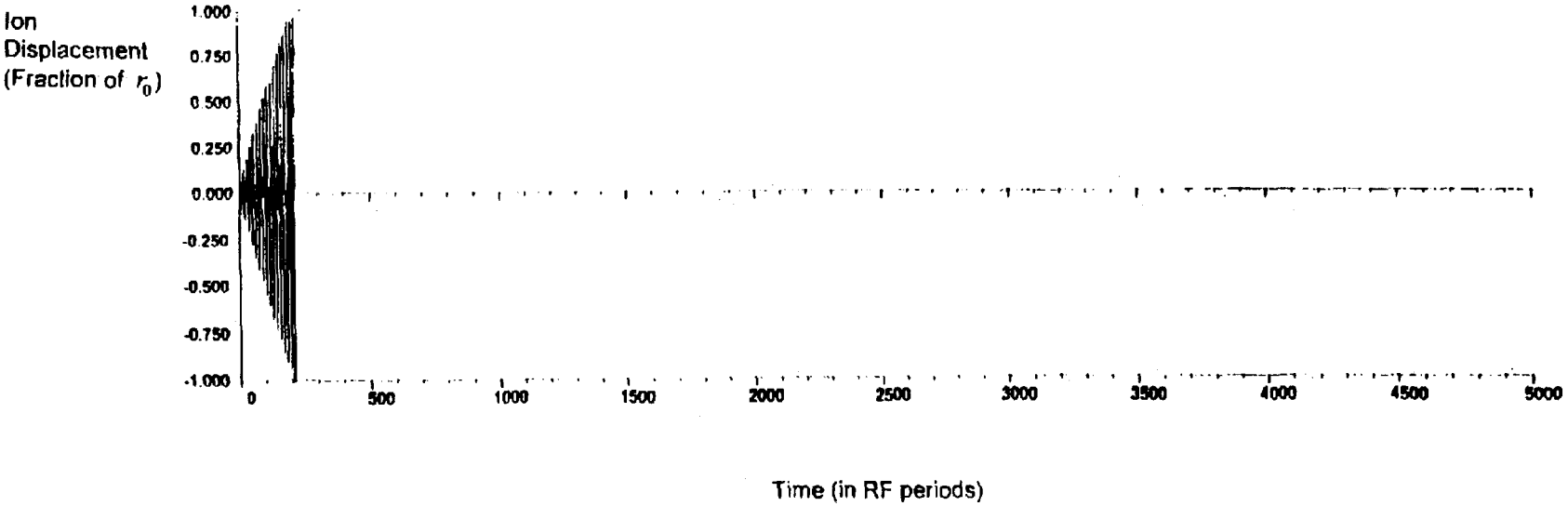
FIG. 9A is a graph plotting ion displacement, expressed as a fraction of the distance from the quadrupole axis to the rods, as a function of time in RF periods due to a second selected field acting on the ion.

Referring to FIG. 9A, ion displacement as a fraction of $r_0$ is plotted against time in periods of the quadrupole RF field. The ion of FIG. 9A has been subjected to a second field. In generating this second field, a dipole excitation voltage has been applied between the X rods 112 and 114, but there is no dipole excitation voltage applied between the Y rods 116 and 118. The amplitude of this dipole excitation voltage is 0.30 V and its frequency is 57.6 kHz, which corresponds to n=0 in equation 8. All the other parameters remain the same as per FIG. 8A.

Figure 9B:
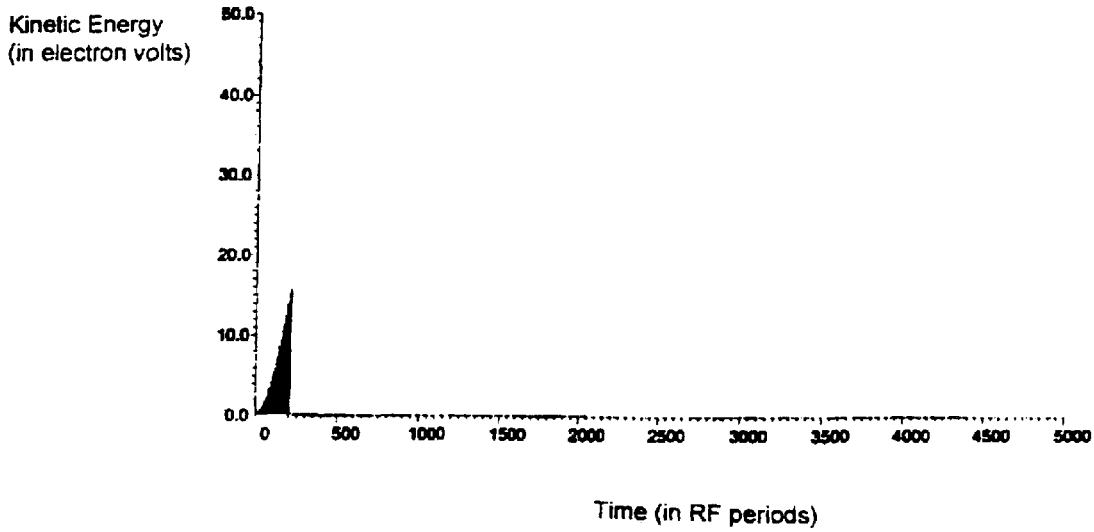
FIG. 9B is a graph plotting the kinetic energy, in electron volts, imparted to the ion of FIG. 9A against time in RF periods.
Figure 9C:
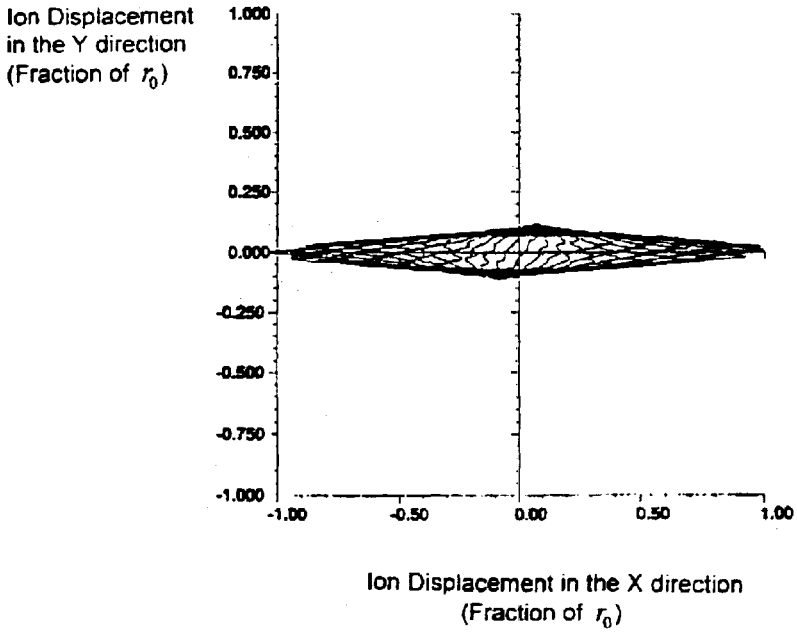
FIG. 9C is a graph plotting the displacement of the ion of FIG. 9A in the Y direction against the displacement in the X direction.

Unlike the trajectory of FIG. 8A, the amplitude of displacement in the X direction increases substantially. As the amplitude of ion displacement in the X direction increases, the ion kinetic energy also increases. However, the amplitude increases so much, and so much kinetic energy is imparted to the ion, that it strikes an X rod and is lost after a time of 210 periods. This can also be seen from FIG. 9B, which plots the kinetic energy in electron volts (eV) imparted to the ion of FIG. 9A against time in periods of the quadrupole RF field. As shown, the kinetic energy averaged over each period of the ion motion increases over time, until a time of 210 periods, at which point the ion is lost. Referring to FIG. 9C, it can be seen that the excitation of the ion is largely confined to the X direction. The amplitude of oscillation in the Y direction remains small, as it is only motion in the X direction that is excited.

Figure 10A:
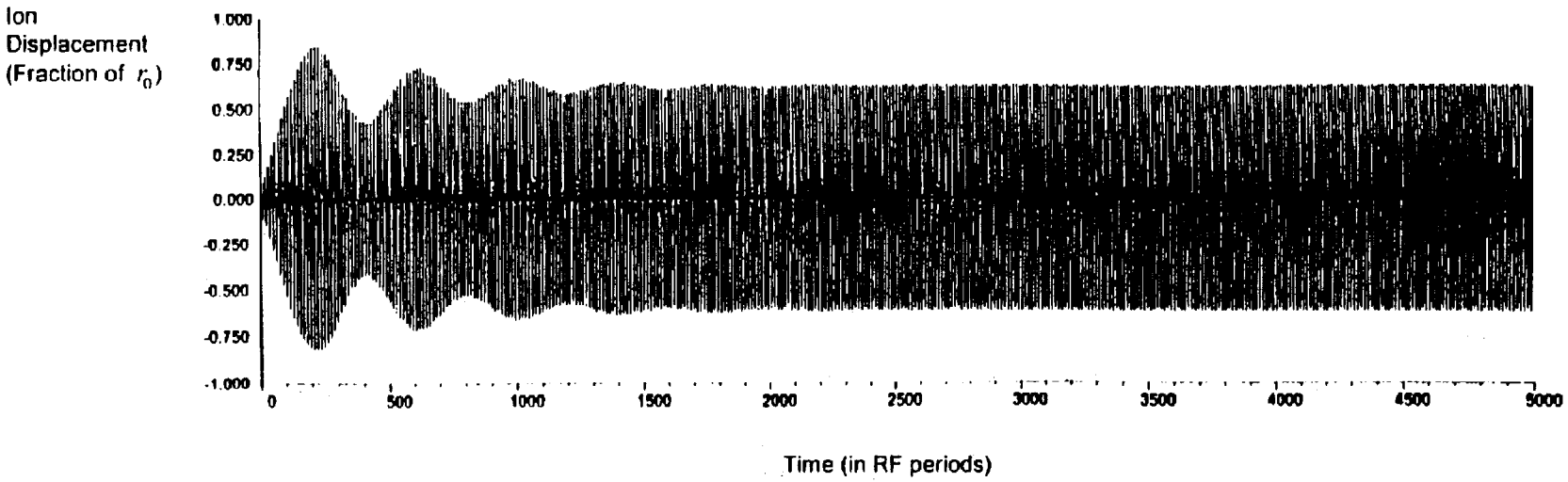
FIG. 10A is a graph plotting ion displacement, expressed as a fraction of the distance from the quadrupole axis to the rods, as a function of time in RF periods due to a third selected field acting on the ion.
Figure 10B:
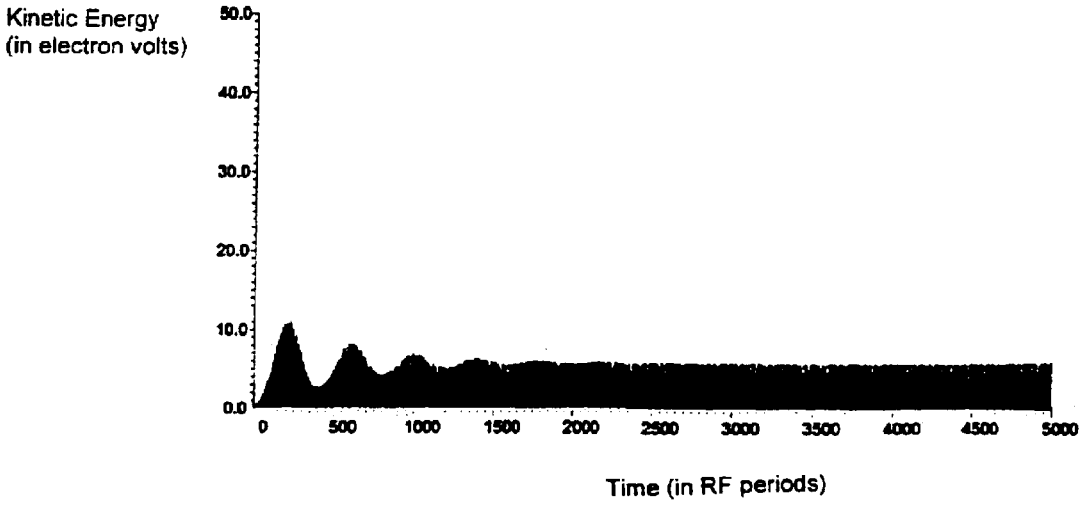
FIG. 10B is a graph plotting the kinetic energy, in electron volts, imparted to the ion of FIG. 9A over time in RF periods.
Figure 10C:
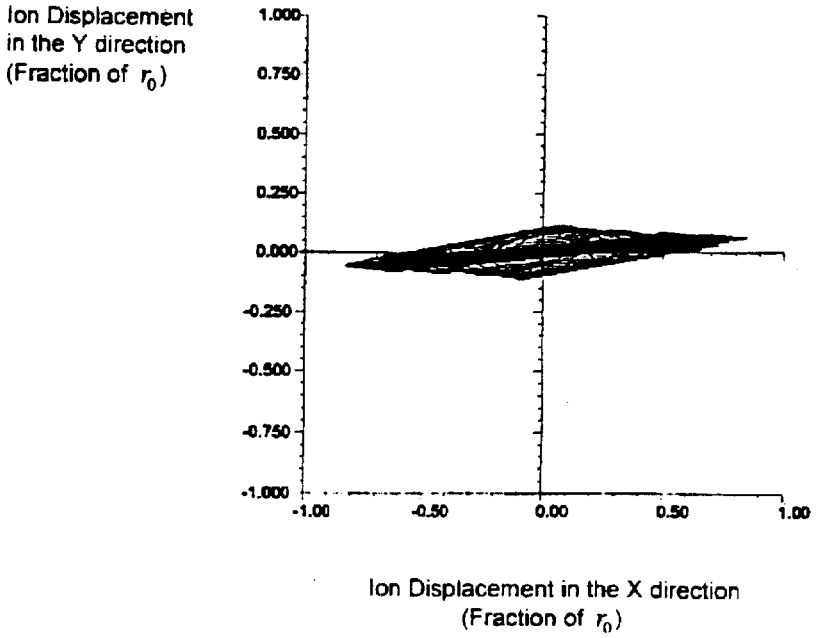
FIG. 10C is a graph plotting the displacement of the ion of FIG. 10A in the Y direction against the displacement of the ion in the X direction.

Referring to FIG. 10A, ion displacement as a fraction of $r_0$ is again plotted against time in periods of the quadrupole RF field. All of the parameters are the same as in FIG. 9A, except that a 2% octopole field was added to the quadrupole field. As shown in FIG. 10A, the amplitude of displacement of the ion in the X direction first increases to a relatively high fraction of $r_0$ (about 0.8) and then diminishes to a smaller amplitude (about 0.4). This pattern is a consequence of the resonant frequency of the ion depending on its amplitude of displacement when an octopole or other multipole component with $N \geqq 3$ is present. As the amplitude of displacement of the ion increases, the resonant frequency of the ion shifts relative to the excitation frequency (for an anharmonic ocillator, this shift is described in L. Landau and E. M. Lifshitz, *Mechanics*, Third Edition, Pergamon Press, Oxford 1966, pages 84–87). The ion motion becomes out of phase with the excitation frequency, thereby reducing the kinetic energy imparted by the field to the ion such that the amplitude of motion of the ion diminishes. As the amplitude of motion decreases once again the resonant frequency of the ion matches the frequency of the excitation field, such that energy is again imparted to the ion and its amplitude once again increases. Referring to FIG. 10B, this relationship can be seen in that the kinetic energy averaged over each period of the ion motion, imparted to the ion over time gradually increases and decreases, until eventually, a steady state is reached. Referring to FIG. 10C, it can be seen that similar to the FIG. 9C, the movement of the ion is largely confined to the X direction, as the dipole excitation voltage is applied only to the X rods 112 and 114. In comparison to FIG. 9A, as illustrated by the trajectories in FIG. 10A, adding an octopole field allows ions to be excited for longer periods of time without being ejected from the field. During the excitation, the ion accumulates internal energy through energetic collisions with the background gas and eventually, when it has gained sufficient internal energy, fragments. Thus, to induce fragmentation, it is advantageous to be able to excite ions for long periods of time without having the ions ejected from the field. Of course, it will be appreciated by those skilled in the art that the amount of octopole field must not be made too large relative to the quadrupole component of the field.

Figure 11A:
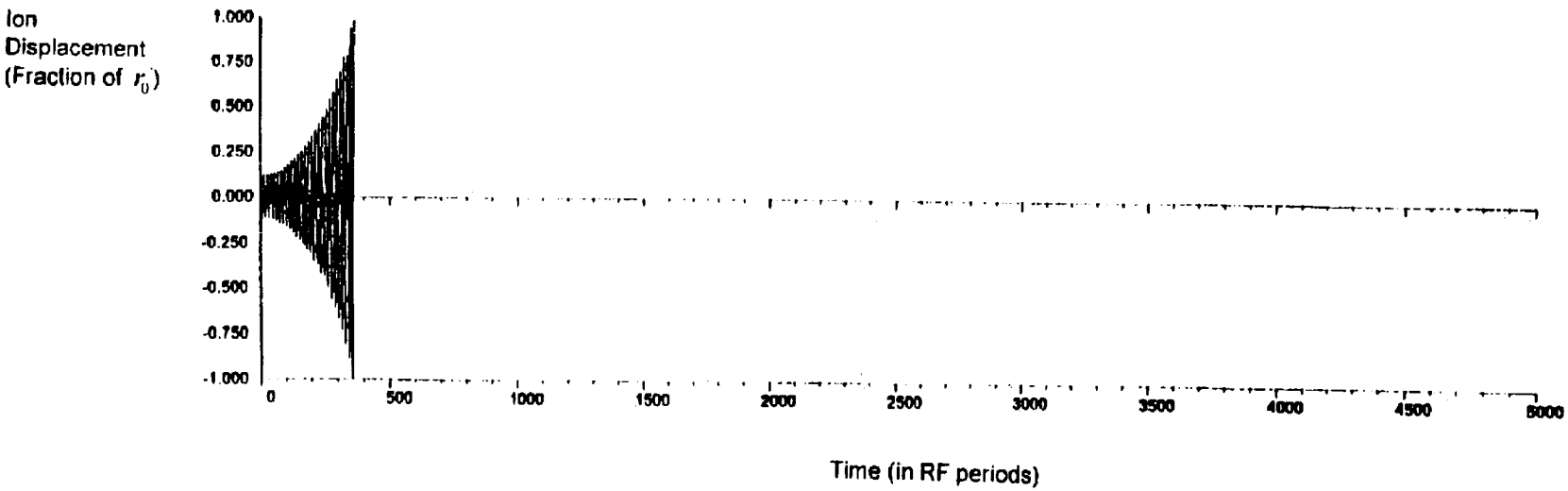
FIG. 11A is a graph plotting ion displacement, expressed as a fraction of the distance from the quadrupole axis to the rods, as a function of time in RF periods due to a fourth selected field acting on the ion.

Referring to FIG. 11A, the displacement of an ion subjected to a quadrupole excitation field is plotted against time in periods of the quadrupole RF field. The amplitude of the excitation voltage applied to both the X and Y rods is 0.5 volts and the excitation frequency is 115 kHz which corresponds to m=0 and K=1 in equation 13. The quadrupole field has no added octopole component. All the other parameters remain the same as the parameters for FIGS. 8 to 10.

Figure 11B:
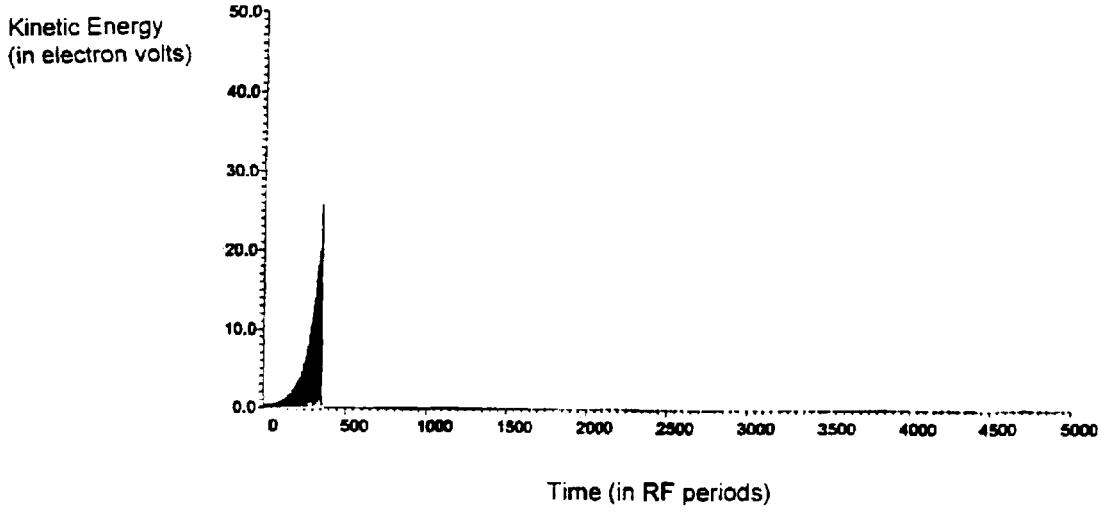
FIG. 11B is a graph plotting the kinetic energy, in electron volts, imparted to the ion of FIG. 11A over time in RF periods.
Figure 11C:
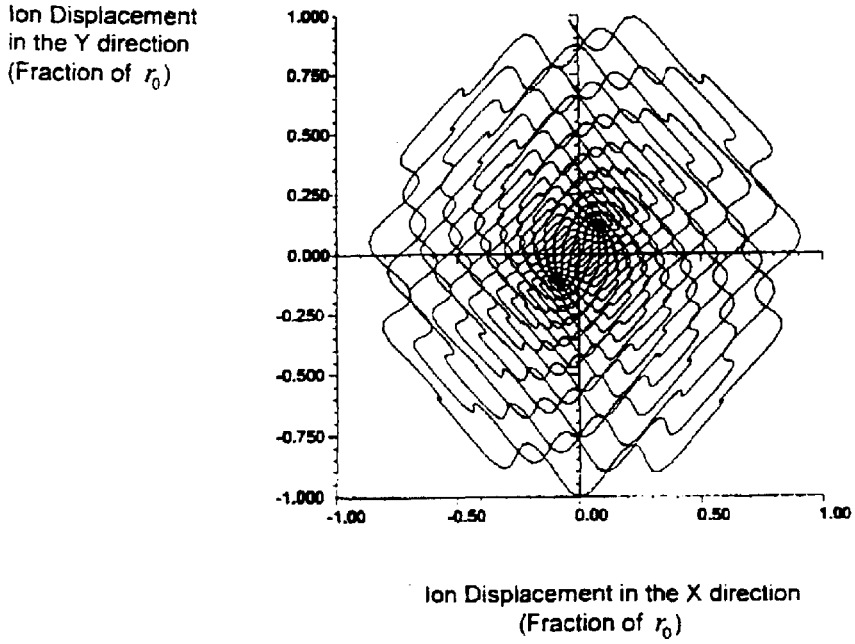
FIG. 11C is a graph plotting the displacement of the ion of FIG. 11A in the Y direction against the displacement in the X direction.

As shown in FIG. 11A, the amplitude of ion oscillation gradually increases over time until a time of 350 periods at which point the ion strikes a Y rod and is lost. Referring to 11B, the kinetic energy averaged over each period of the ion motion received by the ion can be seen to gradually increase until a time after 350 periods, at which point the ion is lost. FIG. 11C plots the displacement of the ion in the X direction against the displacement of the ion in the Y direction. Unlike FIGS. 8 to 10, the ion of FIG. 11C moves throughout the XY plane of the quadrupole, before being lost.

Figure 12A:
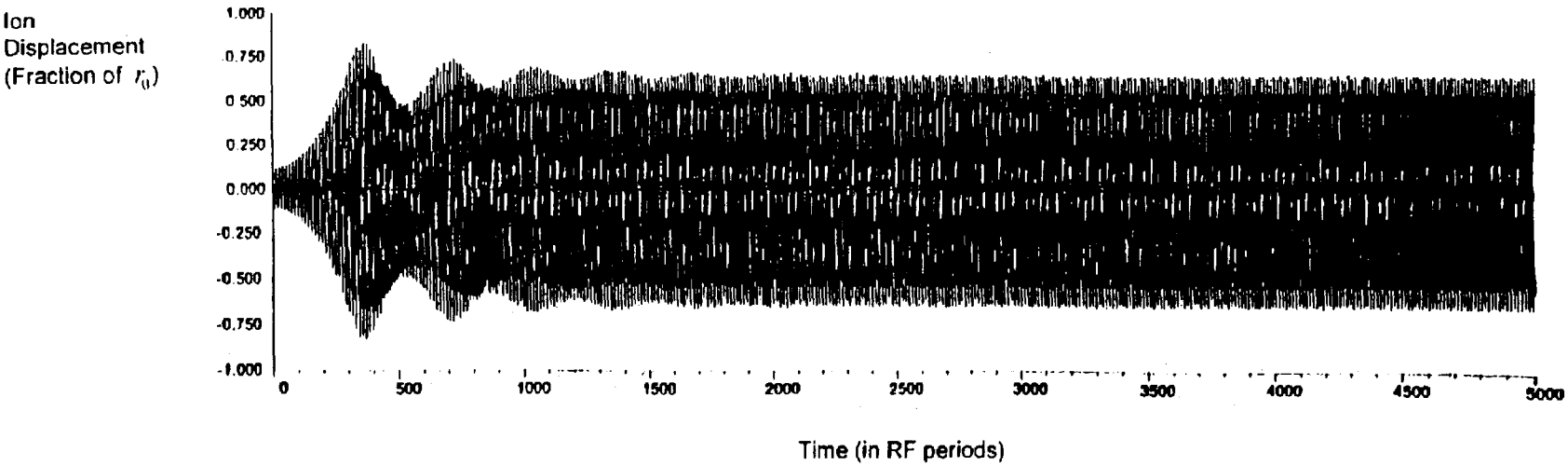
FIG. 12A is a graph plotting ion displacement, expressed as a fraction of the distance from the quadrupole axis to the rods, as a function of time in RF periods due to a fifth selected field acting on the ion.

Referring to FIG. 12A, the displacement of an ion as a fraction of $r_0$ is plotted against time in periods of the quadrupole RF field. The ion is subjected to a field similar to the field of FIG. 11A in all respects, except that it has been supplemented by an octopole component. The octopole component is 2% of the mainly quadrupole field. All other parameters remain the same as the parameters of FIG. 11.

Figure 12B:
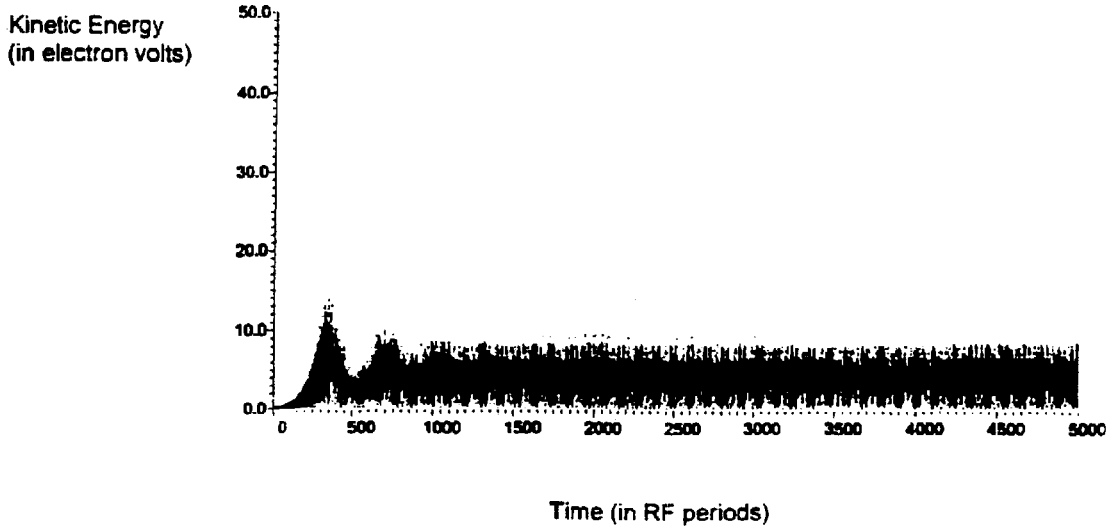
FIG. 12B is a graph plotting the kinetic energy, in electron volts, imparted to the ion of FIG. 12A over time in RF periods.
Figure 12C:
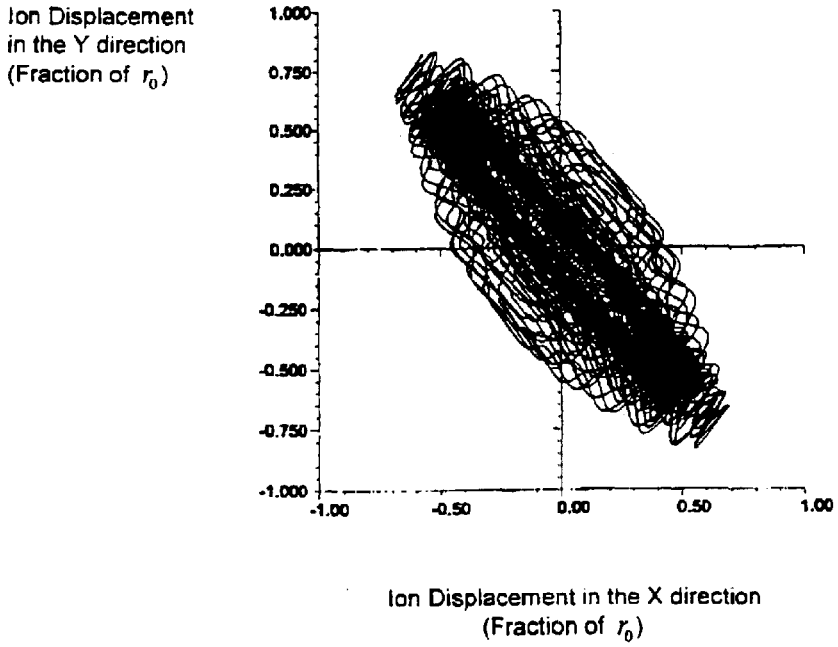
FIG. 12C is a graph plotting the displacement of the ion of FIG. 12A in the Y direction against the displacement in the X direction.

Similar to FIG. 10A, the displacement of the ion shown in FIG. 12A gradually increases over time, due to the auxiliary quadrupole excitation, until it reaches a maximum of approximately 0.8 $r_0$. At this point, the resonant frequency of the ion shifts and, the ion motion moves out of phase with the frequency of the quadrupole excitation field. Consequently, the displacement diminishes and the ion moves gradually back into phase with the frequency of the quadrupole excitation field, whereupon the amplitude of displacement of the ion once again increases. Referring to FIG. 12B, the kinetic energy averaged over one period of the oscillation of the ion increases until the time is equal to about 350 periods, at which point the kinetic energy diminishes, but again increases as the ion moves back into phase with the quadrupole excitation field. Referring to FIG. 12C, the displacement of the ion in the Y direction is plotted against the displacement of the ion in the X direction. Again, similar to FIG. 11C, the ion can be seen to have moved throughout the XY plane of the quadrupole. Thus with quadrupole excitation, as with dipole excitation, addition of a small octopole component to the field allows the ion to be excited for much longer periods of time to increase the internal energy that can be imparted to an ion to induce fragmentation.

Addition of an octopole component to the quadrupole field can also improve the scan speed and resolution that is possible in ejecting trapped ions from a two-dimensional quadrupole field. Ejection can be done in a mass selective instability scan or by resonant ejection, both of which are described in U.S. Pat. No. 5,420,425. These two cases are considered separately.

Mass Analysis of Trapped Ions by Ejection at the Stability Boundary

In the two-dimensional ion trap, ions are confined radially by a two-dimensional quadrupole field. These trapped ions can be ejected through an aperture or apertures in a rod or rods to an external detector by increasing the RF voltage so that ions reach the boundary of the stability region (at q=0.908 for the first stability region) and are ejected. Unlike the three-dimensional trap, there is no confinement of ions in the z direction by quadrupole RF fields. As shown in M. Sudakov, "Effective Potential and the Ion Axial Beat Motion Near the Boundary of the First Stable Region in a Non-Linear Ion Trap", *International Journal of Mass Spectrometry,* 2001, Vol. 206, 27–43, when there is a positive octopole component of the field in the direction of ion ejection, ions are ejected more quickly at the stability boundary, and therefore higher resolution and scan speed are possible in a mass selective stability scan than in a field without an octopole component. Here a "positive" octopole component means the magnitudes of the potential and electric field increase more rapidly with distance from the center than would be the case for a purely quadrupole field.

The field generated will be strongest in the direction of the smaller rods. Therefore, a positive octopole component will be generated in the direction of the smaller rods. Thus, a detector should be located outside the smaller rods.

Mass Analysis of Trapped Ions by Resonant Ejection

When the octopole component is present, ions can still be ejected from the linear quadrupole trap by resonant excitation, but greater excitation voltages are required. With dipole excitation, a sharp threshold voltage for ejection is produced. Thus, if ions are being ejected by resonant excitation, they move from having stable motion to unstable motion more quickly as the trapping RF field or other parameters are adjusted to bring the ions into resonance for ejection. This means the scan speed can be increased and the mass resolution of a scan with resonant ejection can be increased.

With quadrupole excitation, two thresholds need to be distinguished. As discussed in B. A. Collings and D. J. Douglas, "Observation of Higher Order Quadrupole Excitation Frequencies in a Linear Ion Trap", *Journal of the American Society of Mass Spectrometry,* 2000, Vol. 11, 1016–1022 and in L. Landau and E. M. Lifshitz, "Mechanics", Third Edition, 1966, Vol. 1, 80–87, Pergamon Press, Oxford, when ions have their motion damped by collisions, there is a threshold voltage for excitation. This is referred to here as the "damping threshold". If the excitation voltage is below the damping threshold, the amplitude of ion motion decreases exponentially with time, even when the excitation is applied. (Somewhat like the trajectories in FIG. 8A). If the amplitude of excitation is above the damping threshold, the amplitude of ion motion increases exponentially with time and the ions can be ejected, as can be seen in FIG. 11A. When the octopole component is present and ions are excited with amplitudes above the damping threshold, ions can be excited, but still confined by the field, as shown in FIG. 12A. However if the amplitude of the quadrupole excitation is increased, ions can still be ejected. Thus, there is a second threshold—the ion ejection threshold. This means, as with dipole excitation, that the scan speed and resolution of mass analysis by resonant ejection can be increased.

The field generated will be strongest in the direction of the smaller rods. Therefore, a positive octopole component will be generated in the direction of the smaller rods. Thus, a detector should be located outside the smaller rods.

Operation as a Mass Filter

The above-described quadrupole fields having significant octopole components can be useful as quadrupole mass filters. The term "quadrupole mass filter" is used here to mean a linear quadrupole operated conventionally to produce a mass scan as described, for example, in P. H. Dawson ed., *Quadrupole Mass Spectrometry and its Applications*, Elsevier, Amsterdam, 1976, pages 19–22. The voltages U and V are adjusted so that ions of a selected mass to charge ratio are just inside the tip of a stability region such as the first region shown in FIG. 1. Ions of higher mass have lower a,q values and are outside of the stability region. Ions of lower mass have higher a,q values and are also outside of the stability region. Therefore ions of the selected mass to charge ratio are transmitted through the quadrupole to a detector at the exit of the quadrupole. The voltages U and V are then changed to transmit ions of different mass to charge ratios. A mass spectrum can then be produced. Alternatively the quadrupole may be used to "hop" between different mass to charge ratios as is well known. The resolution can be adjusted by changing the ratio of DC to RF voltages (UN) applied to the rods.

It has been expected that for operation as a mass filter, the potential in a linear quadrupole should be as close as possible to a pure quadrupole field. Field distortions, described mathematically by the addition of higher multipole terms to the potential, have generally been considered undesirable (see, for example, P. H. Dawson and N. R. Whetton, "Non-linear Resonances in Quadrupole Mass Spectrometers Due to Imperfect Fields", *International Journal of Mass Spectrometry and Ion Physics,* 1969, Vol. 3, 1–12, and P. H. Dawson, "Ion Optical Properties of Quadrupole Mass Filters", *Advances in Electronics and Electron Optics,* 1980, Vol. 53, 153–208). Empirically, manufacturers who use round rods to approximate the ideal hyperbolic rod shapes, have found that a geometry that adds small amounts of 12-pole and 20-pole potentials, gives higher resolution and gives peaks with less tailing than quadrupoles constructed with a geometry that minimizes the 12-pole potential. It has been shown that this is due to a fortuitous cancellation of unwanted effects from the 12- and 20-pole terms with the optimized geometry. However the added higher multipoles still have very low magnitudes (ca. $10^{-3}$) compared to the quadrupole term (D. J. Douglas and N. V. Konenkov, "Influence of the $6^{th}$ and $10^{th}$ Spatial Harmonics on the Peak Shape of a Quadrupole Mass Filter with Round Rods", *Rapid Communications in Mass Spectrometry,* 2002, Vol. 16, 1425–1431).

The inventors have constructed rod sets, as described above, that contain substantial octopole components (typically between 2 to 3% of $A_2$). In view of all the previous literature on field imperfections, it would not be expected that these rod sets would be capable of mass analysis in the conventional manner. However, the inventors have discovered that the rod sets can in fact give mass analysis with resolution comparable to a conventional rod set provided the polarity of the quadrupole power supply is set correctly and the rod offset of the quadrupole is set correctly. Conversely if the polarity is set incorrectly, the resolution is extremely poor.

Rod Polarity Effects

FIGS. 13 to 16 are mass spectra generated by a mass spectrometer using a quadrupole field with an octopole component $A_4$=0.026 ($R_y$=1.30$R_x$); ($R_x$=$r_x$=$r_y$). The other harmonics' amplitudes can be determined from the graph of FIG. 4. In all cases, the quadrupole frequency was 1.20 MHz, the length of the quadrupole was 20 cm, the distance of the rods from the central axis was 4.5 mm. The scan was conducted on individual 0.1 $m_{ion}$/e intervals along the horizontal axis, which shows mass to charge ratio. On each interval, ions were counted for 10 milliseconds, and then after a 0.05 millisecond pause, the scan was moved to the next $m_{ion}$/e value. Fifty scans of the entire range were performed, and the numbers of ions counted for each interval were then added up over these entire 50 scans. A computer and software acting as a multi-channel scalar were used in the scans. The vertical axes of all of the graphs show the ion count rates normalized to 100% for the highest peaks.

Figure 13:
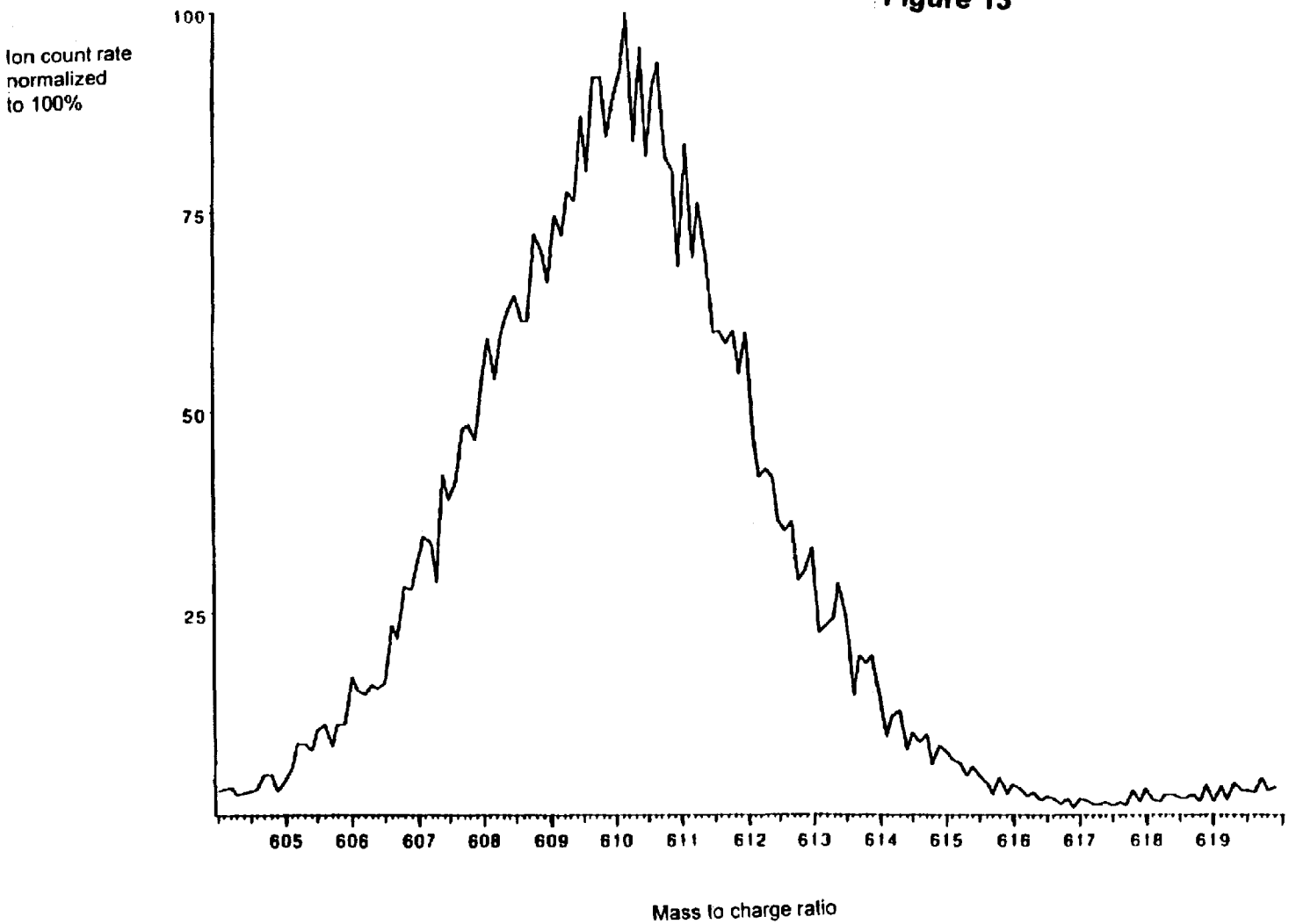
FIG. 13 is a graph showing the mass spectrum of protonated reserpine ions generated by a sixth selected field acting on the protonated reserpine ions.
Figure 14:
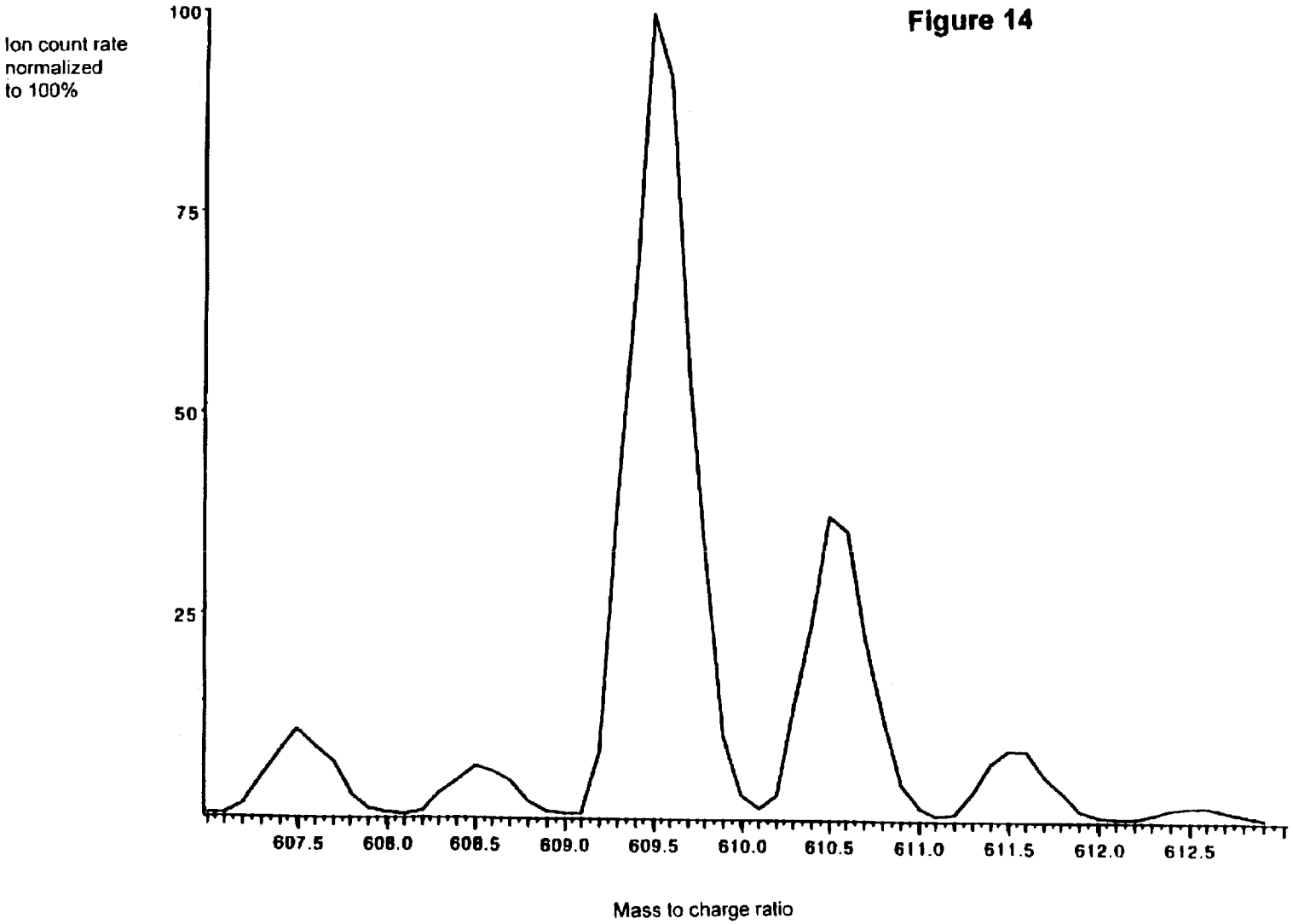
FIG. 14 is a graph showing the mass spectrum of protonated reserpine ions generated by a seventh selected field acting on the ions.

FIG. 13 shows the resolution obtained with positive ions of mass to charge ratio $m_{ion}$/e=609 (protonated reserpine) when the positive DC voltage of the quadrupole power supply is connected to the larger diameter rod pair, and the negative DC voltage is connected to the smaller diameter rod pair. A broad peak with a resolution at half height of $R_{1/2}$=135 is formed. Changes to the rod offset, balance or ratio of RF to DC voltage do not increase the resolution substantially, although they can change the signal intensity. FIG. 14 shows the resolution for the same ion when the positive output is connected to the smaller rod pair and the negative output is connected to the larger rod pair. The resolution is dramatically improved to $R_{1/2}$=1590, and can be adjusted by changing the ratio of RF to DC voltage. In this way, a resolution of up to $R_{1/2}$=5600 has been obtained at this mass to charge ratio.

Figure 15:
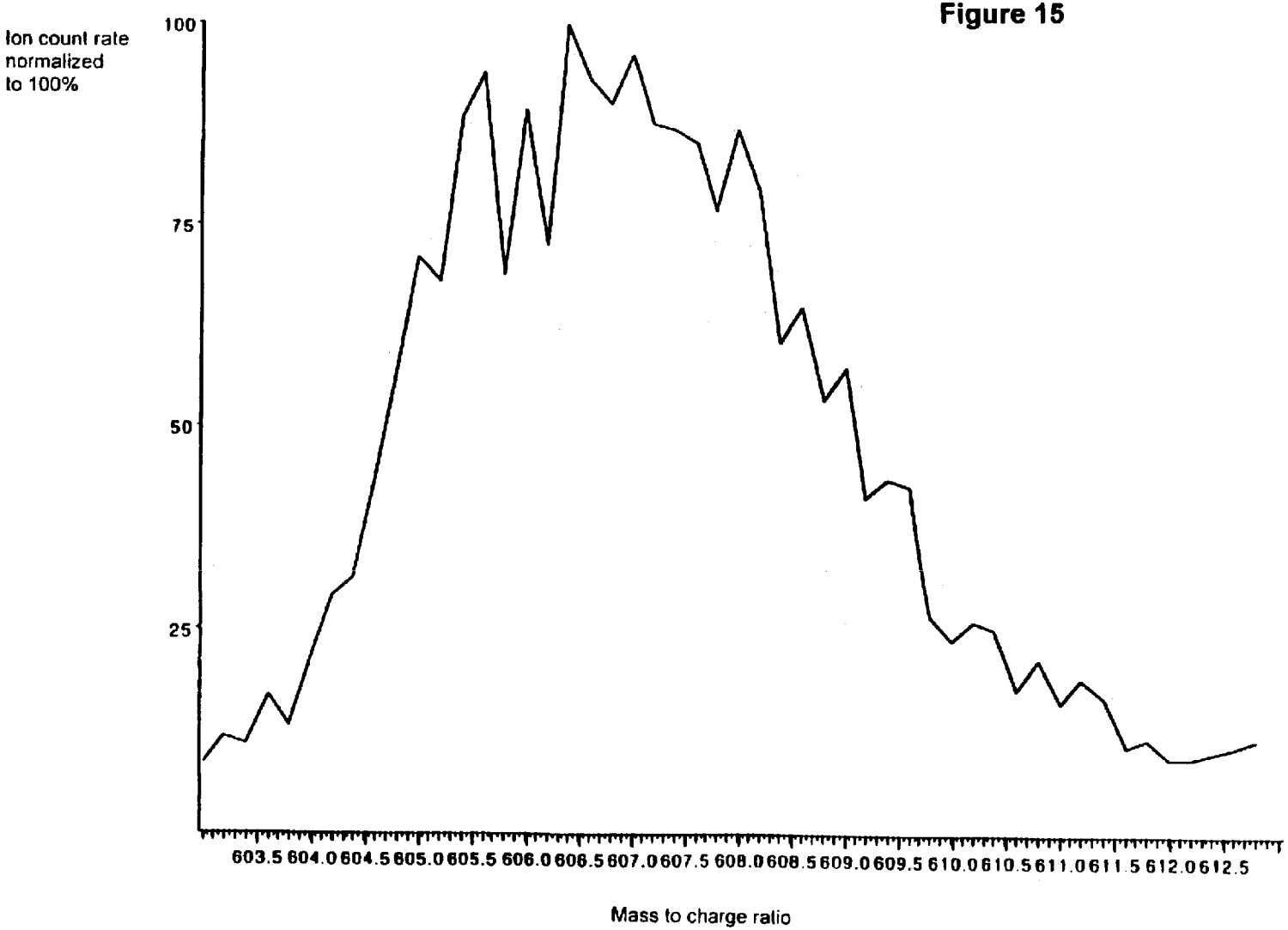
FIG. 15 is a graph showing the mass spectrum of negative ions of reserpine generated by a eighth selected field.
Figure 16:
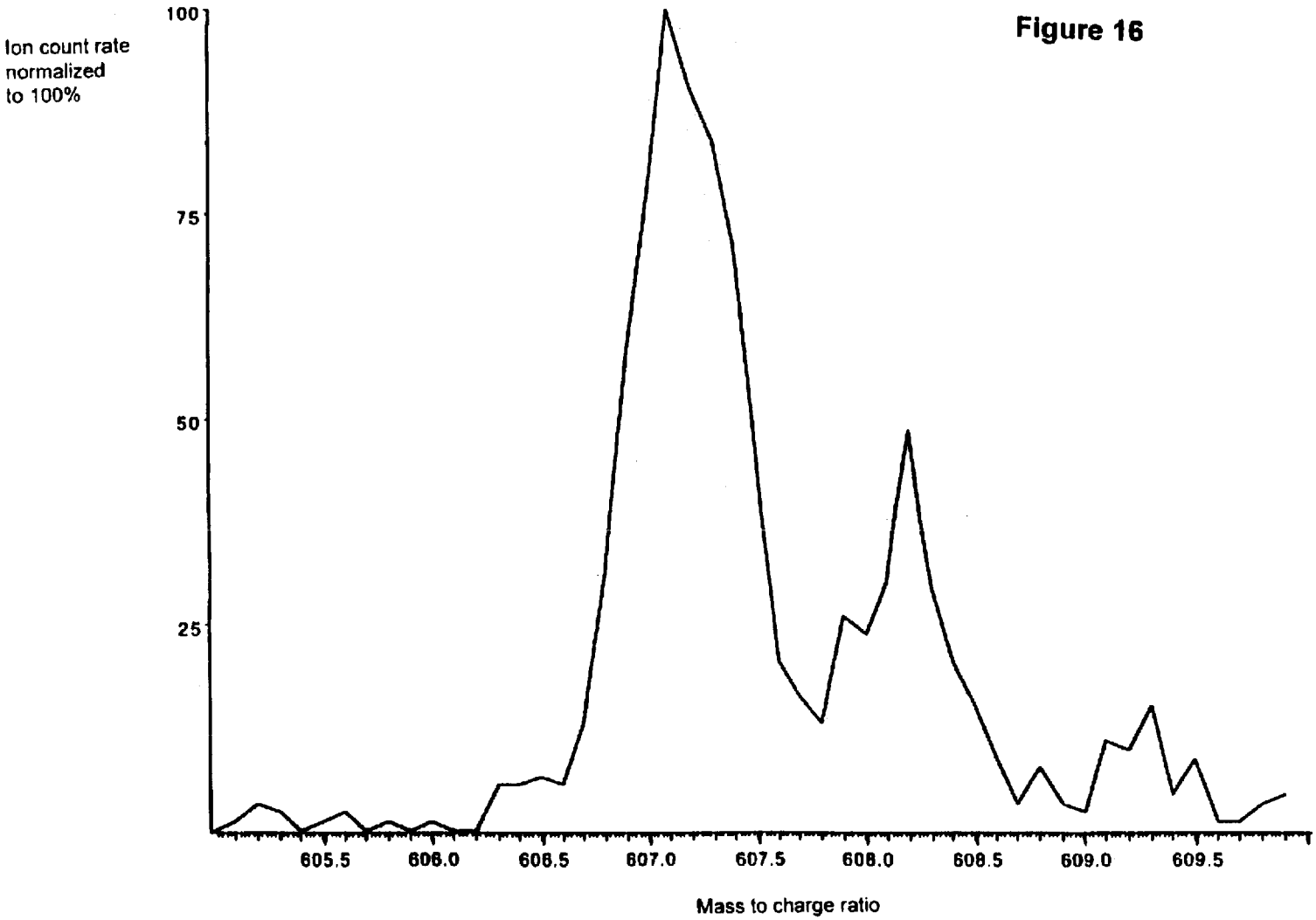
FIG. 16 is a graph showing the mass spectrum of negative ions of reserpine generated by a ninth selected field acting on the ions; and, FIG. 17 is a diagrammatic view of a mass spectrometer system on which an aspect of the invention involving axial ejection may be implemented.

FIG. 15 shows the mass spectrum of negative ions of reserpine, that is obtained when the negative DC voltage output is connected to the larger rods and the positive DC voltage output is connected to the smaller rods. The resolution at half height is $R_{1/2}$=135 and cannot be significantly improved by changing the rod offset, balance or ratio of RF to DC voltage settings, although these settings can change the signal intensity. FIG. 16 shows the resolution obtained with the same ions but when the positive DC voltage output is connected to the larger diameter rods and the negative DC voltage output is connected to the smaller rods. The resolution at half height is improved to $R_{1/2}$=1015, and can be adjusted with the ratio of RF to DC voltages applied to the rods. These results show that to obtain high resolution for positive ions, it is necessary to connect the positive output of the quadrupole supply to the smaller rods, and for negative ions, it is necessary to connect the negative output to the smaller rods.

Briefly, to obtain high resolution, the smaller rods should be given the same polarity as the ions to be mass analyzed.

When positive ions are analyzed, the negative output of the quadrupole supply is preferably connected to the larger rods. If a balanced DC potential is applied to the rods, there will be a negative DC axis potential, because a small portion of the DC voltage applied to the larger rods appears as an axis potential. The magnitude of this potential will increase as the quadrupole scans to higher mass (because a higher DC potential is required for higher mass ions). To maintain the same ion energy within the quadrupole (in order to maintain good resolution), it will be necessary to increase the rod offset as the mass filter scans to higher mass. Similarly, it will be necessary to adjust the rod offset with mass during a scan with negative ions. In this case the axis potential caused by balanced DC becomes more positive (less negative) at higher masses, and it will be necessary to make the rod offset more negative as the quadrupole scans to higher mass. Thus in general, if a balanced DC potential U is applied to the rod sets with different diameter rod pairs, it will be necessary to adjust the rod offset potential for ions of different $m_{ion}$/e values, in order to maintain good performance.

If an unbalanced DC is applied to the rods to make the axis potential zero, it will not be necessary to adjust the rod offset as the mass is scanned. Tests show that the resolution is not changed between running with balanced and unbalanced RF, provided the ratio of RF/DC between rods is suitably adjusted.

According to a further preferred embodiment of the invention, an octopole component is included in a two dimensional substantially quadrupole field provided in a mass spectrometer as described in U.S. Pat. No. 6,177,668, issued Jan. 23, 2001 to MDS Inc., which is incorporated by reference. That is, aspects of the present invention may usefully be applied to mass spectrometers utilizing axial ejection.

Figure 17:
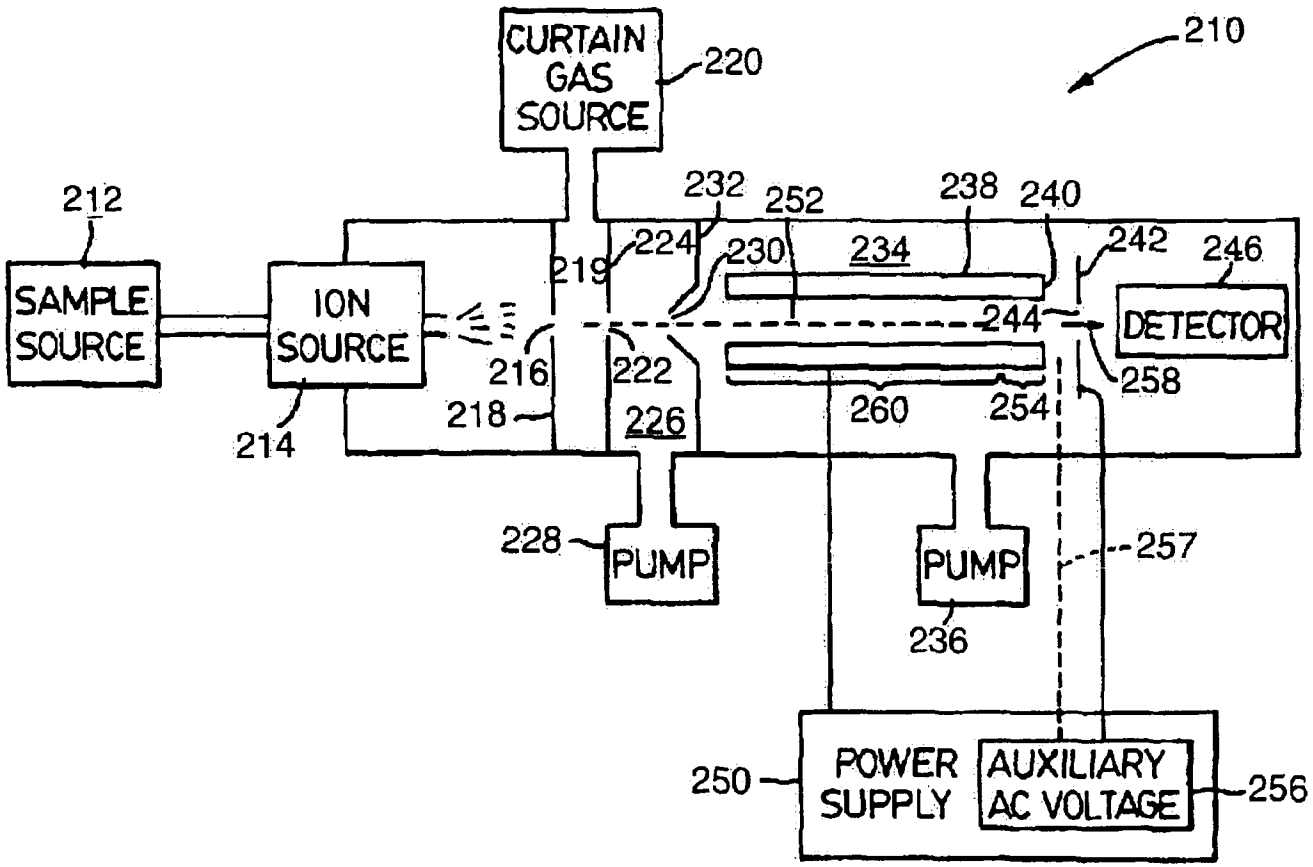

Referring to FIG. 17, there is illustrated a mass analyzer system 210, which is configured to permit axial ejection. The system 210 includes a sample source 212 (normally a liquid sample source such as a liquid chromatograph) from which a sample is supplied to an ion source 214. Ion source 214 may be an electrospray, an ion spray, or a corona discharge device, or any other ion source. An ion spray device of the kind shown in U.S. Pat. No. 4,861,988 issued Aug. 29, 1989 to Cornell Research Foundation Inc. is suitable.

Ions from ion source 214 are directed through an aperture 216 in an aperture plate 218. Plate 218 forms one wall of a gas curtain chamber 219 which is supplied with curtain gas from a curtain gas source 220. The curtain gas can be argon, nitrogen or other inert gas. The ions then pass through an orifice 222 in an orifice plate 224 into a first stage vacuum chamber 226 evacuated by a pump 228 to a pressure of about 1 Torr.

The ions then pass through a skimmer orifice 230 in a skimmer, which is mounted on skimmer plate 232 and into a main vacuum chamber 234 evacuated to a pressure of about 2 milli-Torr by a pump 236.

The main vacuum chamber 234 contains a set of four linear quadrupole rods 238 (it will, of course, be appreciated by those of skill in the art that the quadrupole rods and the central axis of the quadrupole rod set may be curved). As described above, the rods 238 comprise two X rods and two Y rods. The radial distance of the Y rods from the quadrupole axis is $r_y$ and the radius of the Y rods is $R_y$. Similarly, the radial distance of the X rods from the quadrupole axis is $r_x$ and the radius of the X rods is $R_x$. As described above, $R_x$ will typically not be equal to $R_y$. These dimensions are selected to impart the desired octopole component to the quadrupole field.

Located about 2 mm past exit ends 240 of the rods 238 is an exit lens 242. The lens 242 is simply a plate with an aperture 244 therein, allowing passage of ions through aperture 244 to a conventional detector 246 (which may for example be a channel electron multiplier of the kind conventionally used in mass spectrometers).

The rods 238 are connected to the main power supply 250, which applies RF voltage between the rods. The power supply 250 and the power supplies for the ion source 214, the aperture and orifice plates 218 and 224, the skimmer plate 232, and the exit lens 242 are connected to common reference ground (connections not shown).

By way of example, for positive ions the ion source 214 may typically be at +5,000 volts, the aperture plate 218 may be at +1,000 volts, the orifice plate 224 may be at +250 volts, and the skimmer plate 232 may be at ground (zero volts). The DC offset applied to rods 238 may be −5 volts. The axis of the device is indicated at 252.

Thus, ions of interest, which are admitted into the device from ion source 214, move down a potential well and are allowed to enter the rods 238. Ions that are stable in the applied main RF field applied to the rods 238 travel the length of the device undergoing numerous momentum dissipating collisions with the background gas. However a trapping DC voltage, typically −2 volts DC, is applied to the exit lens 242. Normally the ion transmission efficiency between the skimmer 232 and the exit lens 242 is very high and may approach 100%. Ions that enter the main vacuum chamber 234 and travel to the exit lens 242 are thermalized due to the numerous collisions with the background gas and have little net velocity in the direction of axis 252. The ions also experience forces from the main RF field, which confines them radially. Typically the RF voltage applied is in the order of about 450 volts, peak-to-peak between pairs of rods (unless it is scanned with mass), and is of a frequency of the order of about 816 kHz. No resolving DC field is applied to rods 238.

When a DC trapping field is created at the exit lens 242 by applying a DC offset voltage which is higher than that applied to the rods 238, the ions stable in the RF field applied to the rods 238 are effectively trapped.

However ions in region 254 in the vicinity of the exit lens 242 will experience fields that are significantly distorted due to the nature of the termination of the main RF and DC fields near the exit lens. Such fields, commonly referred to as fringing fields, will tend to couple the radial and axial degrees of freedom of the trapped ions. This means that there will be axial and radial components of ion motion that are not mutually independent. This is in contrast to the situation at the center of rod structure 238 further removed from the exit lens and fringing fields, where the axial and radial components of ion motion are not coupled or are minimally coupled.

Because the fringing fields couple the radial and axial degrees of freedom of the trapped ions, ions may be scanned mass dependently axially out of the ion trap including the rods 238, by the application to the exit lens 242 of a low voltage auxiliary AC field of appropriate frequency. The auxiliary AC field may be provided by an auxiliary AC supply 256, which for illustrative purposes is shown as forming part of the main power supply 250.

The auxiliary AC field is an addition to the trapping DC voltage supplied to exit lens 242, and excites both the radial and axial ion motions. The auxiliary AC field is found to excite the ions sufficiently that they surmount the axial DC potential barrier at the exit lens 242, so that they can leave approximately axially in the direction of arrow 258. The deviations in the field in the vicinity of the exit lens 242 lead to the above-described coupling of axial and radial ion motions thereby enabling axial ejection. This is in contrast to the situation existing in a conventional ion trap, where excitation of radial secular motion will generally lead to radial ejection and excitation of axial secular motion will generally lead to axial ejection, unlike the situation described above.

Therefore, ion ejection in a sequential mass dependent manner can be accomplished by scanning the frequency of the low voltage auxiliary AC field. When the frequency of the auxiliary AC field matches a radial secular frequency of an ion in the vicinity of the exit lens 242, the ion will absorb energy and will now be capable of traversing the potential barrier present on the exit lens due to the radial/axial motion coupling. When the ion exits axially, it will be detected by detector 246. After the ion is ejected, other ions upstream of the region 254 in the vicinity of the exit lens are energetically permitted to enter the region 254 and be excited by subsequent AC frequency scans.

When the RF field applied to the rods is a substantially quadrupole field without an added octopole, ion ejection by scanning the frequency of the auxiliary AC voltage applied to the exit lens is desirable because it does not empty the trapping volume of the entire elongated rod structure 238. In a conventional mass selective instability scan mode for rods 238, the RF voltage on the rods would be ramped up and ions would be ejected from low to high masses along the entire length of the rods when the q value for each ion reaches a value of 0.907. After each mass selective instability scan, time is required to refill the trapping volume before another analysis can be performed. In contrast, when an auxiliary AC voltage is applied to the exit lens as described above, ion ejection will normally only happen in the vicinity of the exit lens because this is where the coupling of the axial and radial ion motions occurs and where the auxiliary AC voltage is applied. The upstream portion 260 of the rods serves to store other ions for subsequent analysis. The time required to refill the volume 254 in the vicinity of the exit lens with ions will always be shorter than the time required to refill the entire trapping volume. Therefore fewer ions will be wasted.

As an alternative, instead of scanning the auxiliary AC voltage applied to end lens 242, the auxiliary AC voltage on end lens 242 can be fixed and the main RF voltage applied to rods 238 can be scanned in amplitude, as will be described. While this does change the trapping conditions, a q of only about 0.2 to 0.3 is needed for axial ejection, while a q of about 0.907 is needed for radial ejection. Therefore, few if any ions are lost to radial ejection within the rod set in region 260 if the RF voltage is scanned through an appropriate amplitude range, except possibly for very low mass ions.

As a further alternative, and instead of scanning either the RF voltage applied to rods 238 or the auxiliary AC voltage applied to end lens 242, a further supplementary or auxiliary AC dipole voltage or quadrupole voltage may be applied to rods 238 (as indicated by dotted connection 257 in FIG. 17) and scanned, to produce varying fringing fields which will eject ions axially in the manner described. Alternatively, dipole excitation may be applied between the X pair and at the same time additional dipole excitation may be applied between the Y rod pair. This is of particular advantage when the trapping field provided by the RF voltage applied to the rods has an added octopole component. That is, with a conventional rod set, only about 20% of the ions confined in the linear trap can be axially ejected; the remaining 80% appear to be lost by striking the rods (J. Hager, "A New Linear Ion Trap Mass Spectrometer", *Rapid Communications in Mass Spectrometry,* 2002, Vol. 16, 512). However, as described above, with a linear quadrupole having an added octopole field, a greater excitation voltage is required to cause ions to strike the rods, and ions can be continuously excited without striking the rods as shown in FIGS. 10 and 12. Thus, the sensitivity of the system may be improved by adding the octopole field thereby increasing the percentage of ions that are axially ejected by reducing the percentage of ions that strike the rods.

Alternatively, a combination of some or all of the above three approaches (namely scanning an auxiliary AC field applied to the end lens 242, scanning the RF voltage applied to the rod set 238 while applying a fixed auxiliary AC voltage to end lens 242, and applying an auxiliary AC voltage or voltages to the rod set 238 in addition to that on lens 242 and the RF on rods 238) can be used to eject ions axially and mass dependently past the DC potential barrier present at the end lens 242.

Depending on the context, it is sometimes better to have unbalanced RF applied between the rods. In other contexts, it is also advantageous to have DC between the rods, typically 0.5 to 50 volts (see J. Hager, "Performance Optimization and Fringing Field Modification of a Twenty-Four Millimeter Long RF Only Quadrupole Mass Spectrometer", *Rapid Communications in Mass Spectrometry,* 1999, Vol. 13, 740; see also U.S. Pat. No. 6,177,668). It depends on the context. Accordingly, it is advantageous to have as many different modes of operation as possible, as different modes of operation may be preferred in different contexts. As described above, if DC is applied between rods that are not symmetrical under a 90 degree rotation about the quadrupole axis, then it may be necessary to adjust the rod offset to obtain the desired axis DC potential.

As the rod sets according to the present invention that have added octopole fields differ in the X and Y directions, there are more modes of operation for axial ejection than with a conventional rod set, which has four-fold symmetry. The excitation can be applied as a voltage to the exit aperture, as dipole excitation between the smaller rods or between the larger rods, as quadrupole excitation or as dipole excitation applied between the larger pair with, at the same time, dipole excitation applied between the smaller rod pair. In addition, the trapping field can be RF-only with the RF balanced or unbalanced, or contain a DC component with positive DC applied to the smaller rods or with positive DC applied to the larger rods. Several modes of operation with positive ions are shown below:

| Trapping Voltage | DC Between Rods | Excitation Mode |
|---|---|---|
| RF balanced | None | Aperture |
| RF unbalanced, greater V provided to the smaller rods | +smaller rods | Dipole smaller rods |
| RF unbalanced, greater V provided to the larger rods | +larger rods | Dipole larger rods |
| | | Quadrupole |
| | | Auxiliary AC voltage applied to aperture and smaller rods |
| | | Auxiliary AC voltage applied to aperture and larger rods |
| | | Auxiliary AC quadrupole voltage applied to aperture and all rods |
| | | Dipole smaller rods and dipole larger rods |
| | | Dipole smaller rods and dipole larger rods and auxiliary AC voltage applied to aperture |

In principle, any of the three trapping voltages can be combined with any of the three methods of applying DC between the rods, which could be used with any of the nine excitation modes. Thus, there are 3×3×9=81 modes of operation for positive ions. With each of these modes, either the RF amplitude is scanned to bring ions sequentially into resonance with the AC excitation field or fields, or else the frequency of the modulation is scanned so that again, when such frequency matches a radial secular frequency of an ion in the fringing fields in the vicinity of the exit lens, the ion will absorb energy and be ejected axially for detection. Thus there are 81×2=162 methods of scanning to mass selectively eject ions axially.

The device illustrated may be operated in a continuous fashion, in which ions entering the main RF containment field applied to rods 238 are transported by their own residual momentum toward the exit lens 242 and ultimate axial ejection. Thus, the ions which have reached the extraction volume in the vicinity of the exit lens have been preconditioned by their numerous collisions with background gas, eliminating the need for an explicit cooling time (and the attendant delay) as is required in most conventional ion traps. At the same time as ions are entering the region 260, ions are being ejected axially from region 254 in the mass dependent manner described.

As a further alternative, the DC offset applied to all four rods 238 (which in the example given is −5 volts) can be modulated at the same frequency as the AC which would have been applied to exit lens 242. In that case no AC is needed on exit lens 242 since modulating the DC offset is equivalent to applying an AC voltage to the exit lens, in that it creates an AC field in the fringing region. Of course the DC potential barrier is still applied to the exit lens 242. The amplitude of the modulation of the DC offset will be the same as the amplitude of the AC voltage which otherwise would have been applied to the exit lens 242, i.e. it is set to optimize the axially ejected ion signal. Then, either the RF amplitude is scanned to bring ions sequentially into resonance with the AC field created by the DC modulation, or else the frequency of the modulation is scanned so that again, when such frequency matches a radial secular frequency of an ion in the fringing fields in the vicinity of the exit lens, the ion will absorb energy and be ejected axially for detection. Preferably, the rod offset would not be modulated until after ions have been injected and trapped within the rods, since the modulation would otherwise interfere with ion injection, so this process would be a batch process. This is in contrast to the continuous process possible when AC is placed on the exit lens, in which case ions can be ejected from the extraction region 254 at the same time as ions are entering region 260 (because the AC field on exit lens 242 does not affect ion injection).

Figure 2:
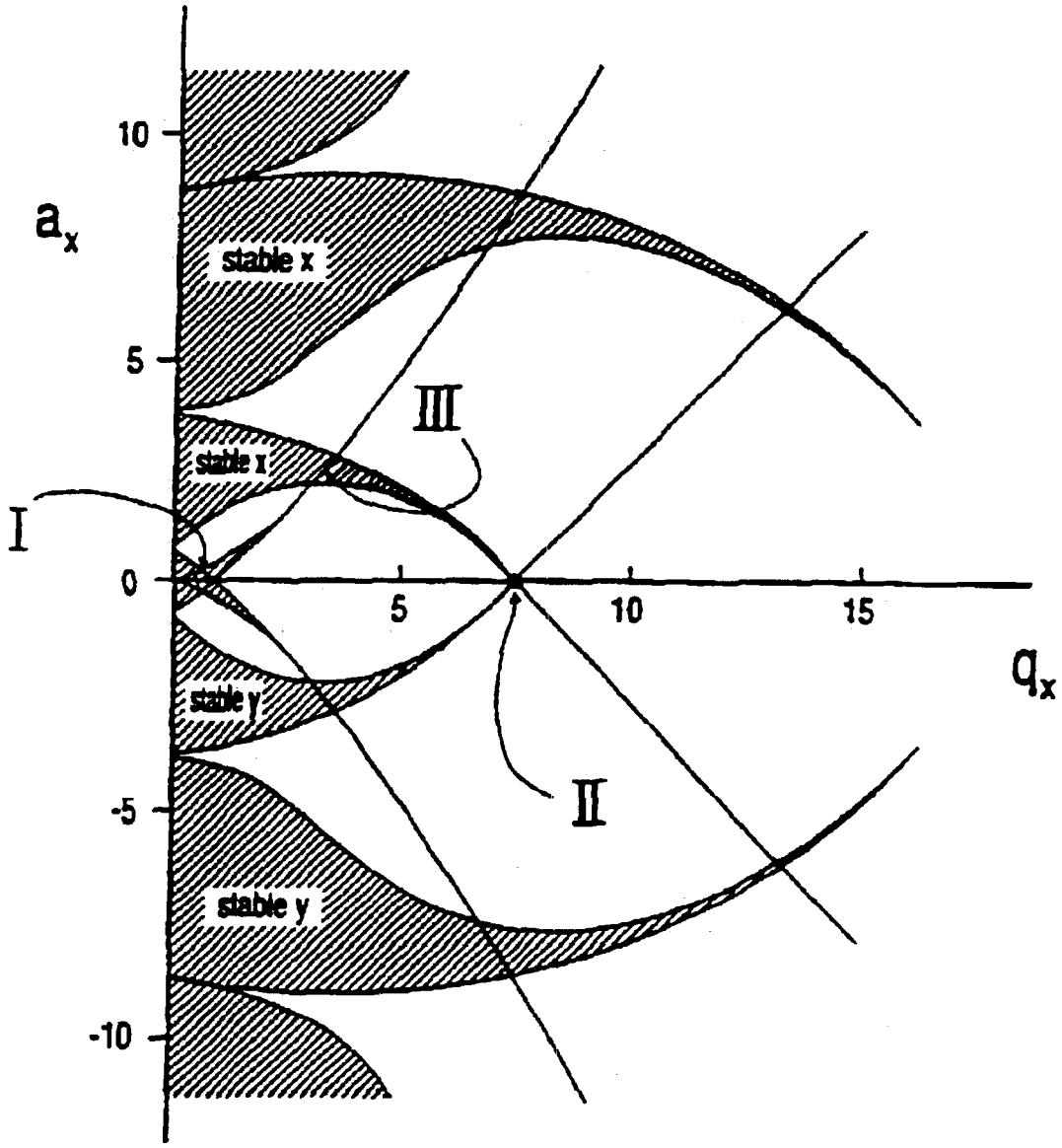
FIG. 2 is a conventional stability diagram showing different stability regions for a quadrupole mass spectrometer.

Other variations and modifications of the invention used with axial ejection are possible. For example the rod set may be used as an ion trap for mass selective axial ejection combined with another ion trap to improve the duty cycle as shown in FIG. 2 of U.S. Pat. No. 6,177,668. The rod set with axial ejection may also be operated at lower pressure such as $2\times10^{-5}$ torr, as shown in FIG. 4 of U.S. Pat. No. 6,177,668. In addition the rod set with axial ejection may be used as a collision cell to produce fragment ions, followed by axial ejection of the fragment ions for mass analysis. Fragment ions may be formed by injecting ions at relatively high energy to cause fragmentation with a background gas or by resonant excitation of ions within the rod set. In some cases it is desirable to operate the same rod set used for axial ejection as a mass filter with mass selection of ions at the tip of the stability diagram (J. Hager, "A New Linear Ion Trap Mass Spectrometer", *Rapid Communications in Mass*

*Spectrometry,* 2002, Vol. 16, 512). Rod sets with added octopole fields can be operated as mass filters as described above.

Other variations and modifications of the invention are possible. For example, quadrupole rod sets may be used with a high axis potential. Further, while the foregoing discussion has dealt with cylindrical rods, it will be appreciated by those skilled in the art that the invention may also be implemented using other rod configurations. For example, hyperbolic configurations may be employed. Alternatively, the rods could be constructed of wires, as described, for example, in U.S. Pat. No. 4,328,420. Also, while the foregoing has been described with respect to quadrupole systems having straight central axes, it will be appreciated by those skilled in the art that the invention may also be implemented using quadrupole electrode systems having curved central axes. All such modifications or variations are believed to be within the sphere and scope of the invention as defined by the claims appended here.

What is claimed is:

1. A method of operating a mass spectrometer having an elongated rod set, said rod set having an entrance end and an exit end and a longitudinal axis, said method comprising:

(a) admitting ions into said entrance end of said rod set, (b) trapping at least some of said ions in said rod set by producing a barrier field at an exit member adjacent to the exit end of said rod set and by producing an RF field between the rods of said rod set adjacent at least the exit end of said rod set, (c) said RF and barrier fields interacting in an extraction region adjacent to said exit end of said rod set to produce a fringing field, and (d) energizing ions in said extraction region to mass selectively eject at least some ions of a selected mass to charge ratio axially from said rod set past said barrier field, wherein said RF field is a two-dimensional substantially quadrupole field having a quadrupole harmonic with amplitude $A_2$, an octopole harmonic with amplitude $A_4$, and a hexadecapole harmonic with amplitude $A_8$, wherein $A_8$ is less than $A_4$, and $A_4$ is greater than 0.1% of $A_2$.

2. The method as defined in claim 1 wherein $A_4$ is greater than 1% of $A_2$ and $A_4$ is less than 6% of $A_2$.

3. The method as defined in claim 1 further comprising detecting at least some of the axially ejected ions.

4. The method as defined in claim 1 wherein the rod set comprises:

(i) a central axis;

(ii) a first pair of rods, wherein each rod in the first pair of rods is spaced from and extends alongside the central axis;

(iii) a second pair of rods, wherein each rod in the second pair of rods is spaced from and extends alongside the central axis; the first pair of rods and the second pair of rods being oriented such that at any point along the central axis, an associated plane orthogonal to the central axis intersects the central axis, intersects the first pair of rods at an associated first pair of cross sections, and intersects the second pair of rods at an associated second pair of cross sections;

the associated first pair of cross sections are substantially symmetrically distributed about the central axis and are bisected by a first axis orthogonal to the central axis and passing through a center of each rod in the first pair of rods;

the associated second pair of cross sections are substantially symmetrically distributed about the central axis and are bisected by a second axis orthogonal to the central axis and passing through a center of each rod in the second pair of rods;

the associated first pair of cross sections and the associated second pair of cross sections are substantially asymmetric under a ninety degree rotation about the central axis; and, the first axis and the second axis are substantially orthogonal and intersect at the central axis.

5. The method as defined in claim 4 wherein each rod in the first pair of rods is substantially parallel to the central axis and has a transverse dimension $D_1$; and, each rod in the second pair of rods is substantially parallel to the central axis and has a transverse dimension $D_2$ less than $D_1$, $D_1/D_2$ being selected such that $A_4$ is greater than 0.1% of $A_2$.

6. The method as defined in claim 4, further comprising a plurality of modes of operation, wherein each mode of operation comprises a trapping voltage sub-mode selected from a plurality of trapping voltage sub-modes, a DC voltage sub-mode selected from a plurality of DC voltage sub-modes, and, an excitation sub-mode selected from a plurality of excitation sub-modes.

7. The method as defined in claim 6 wherein step (b) comprises producing the RF field between the rods of said rod set by applying a first RF voltage to the first pair of rods and a second RF voltage to the second pair of rods; and, the plurality of trapping voltage sub-modes is selected from the group comprising (i) an RF balanced sub-mode wherein an amplitude of the first RF voltage equals an amplitude of the second RF voltage, (ii) a first RF unbalanced sub-mode wherein the amplitude of the first RF voltage exceeds the amplitude of the second RF voltage, and (iii) a second RF unbalanced sub-mode wherein the amplitude of the first RF voltage is less than the amplitude of the second RF voltage.

8. The method as defined in claim 6 wherein the plurality of DC voltage sub-modes is selected from the group comprising, (i) a first DC sub-mode wherein a first positive DC voltage is applied to the first rod pair relative to the second rod pair, (ii) a second DC sub-mode wherein a second positive DC voltage is applied to the second rod pair relative to the first rod pair; and, (iii) a zero DC sub-mode wherein zero DC voltage is applied between the first rod pair and the second rod pair.

9. The method as defined in claim 6 wherein the plurality of excitation sub-modes is selected to be one or more of the group comprising (i) a first excitation sub-mode comprising providing an exit auxiliary AC voltage to the exit member, (ii) a second excitation sub-mode comprising providing a first dipole excitation AC voltage between the first pair of rods; (iii) a third excitation sub-mode comprising providing a second dipole excitation AC voltage between the second pair of rods; (iv) a fourth excitation sub-mode comprising providing a quadrupole excitation AC voltage between the first pair of rods and the second pair of rods; (v) a fifth excitation sub-mode comprising providing an exit auxiliary AC voltage to the exit member and providing the first dipole excitation AC voltage between the first pair of rods, (vi) a sixth excitation sub-mode comprising providing the exit auxiliary AC voltage to the exit member and providing the second dipole excitation AC voltage between the second pair of rods; (vii) a seventh excitation sub-mode comprising providing the exit auxiliary AC voltage to the exit member and providing an auxiliary quadrupole excitation AC voltage between the first pair of rods and the second pair of rods; (viii) an eighth excitation sub-mode comprising providing the first dipole excitation AC voltage between the first pair of rods and providing the second dipole excitation AC voltage between the second pair of rods; and, (ix) a ninth excitation sub-mode comprising providing the exit auxiliary AC voltage to the exit member, providing the first dipole excitation AC voltage between the first pair of rods and providing the second dipole excitation AC voltage between the second pair of rods.

10. The method as defined in claim 6 wherein step (d) comprises scanning the amplitude of the RF field to bring the at least some ions into resonance with at least one excitation field generated by the excitation sub-mode selected from the plurality of excitation sub-modes.

11. A mass spectrometer system comprising:

(a) an ion source;

(b) a main rod set having an entrance end for admitting ions from the ion source and an exit end for ejecting ions traversing a longitudinal axis of the main rod set;

(c) an exit member adjacent to the exit end of the main rod set;

(d) power supply means coupled to the main rod set and the exit member for producing an RF field between rods of the main rod set and a barrier field at the exit end, whereby in use (i) at least some of the ions admitted in the main rod set are trapped within the rods and (ii) the interaction of the RF and barrier fields produces a fringing field adjacent to the exit end, and (e) an AC voltage source coupled to one of: the rods of the main rod set; and the exit member, whereby at least one of the AC voltage source and the power supply means mass dependently and axially ejects ions trapped in the vicinity of the fringing field from the exit end;

wherein said RF field is a two-dimensional substantially quadrupole field having a quadrupole harmonic with amplitude $A_2$, an octopole harmonic with amplitude $A_4$, and a hexadecapole harmonic with amplitude $A_8$, wherein $A_8$ is less than $A_4$, and $A_4$ is greater than 0.1% of $A_2$.

12. The mass spectrometer system as defined in claim 11 wherein $A_4$ is greater than 1% of $A_2$ and $A_4$ is less than 6% of $A_2$.

13. The mass spectrometer system as defined in claim 11 further comprising a detector for detecting at least some of the axially ejected ions.

14. The mass spectrometer system as defined in claim 11 wherein the rod set comprises:

(a) a central axis;

(b) a first pair of rods, wherein each rod in the first pair of rods is spaced from and extends alongside the central axis;

(c) a second pair of rods, wherein each rod in the second pair of rods is spaced from and extends alongside the central axis; the first pair of rods and the second pair of rods being oriented such that at any point along the central axis, an associated plane orthogonal to the central axis intersects the central axis, intersects the first pair of rods at an associated first pair of cross sections, and intersects the second pair of rods at an associated second pair of cross sections;

the associated first pair of cross sections are substantially symmetrically distributed about the central axis and are bisected by a first axis orthogonal to the central axis and passing through a center of each rod in the first pair of rods;

the associated second pair of cross sections are substantially symmetrically distributed about the central axis and are bisected by a second axis orthogonal to the central axis and passing through a center of each rod in the second pair of rods;

the associated first pair of cross sections and the associated second pair of cross sections are substantially asymmetric under a ninety degree rotation about the central axis; and, the first axis and the second axis are substantially orthogonal and intersect at the central axis.

15. The mass spectrometer system as defined in claim 14 wherein each rod in the first pair of rods is substantially parallel to the central axis and has a transverse dimension $D_1$; and, each rod in the second pair of rods is substantially parallel to the central axis and has a transverse dimension $D_2$ less than $D_1$, $D_1/D_2$ being selected such that $A_4$ is greater than 0.1% of $A_2$.

16. The mass spectrometer system as defined in claim 14 wherein the power supply comprises a first RF voltage supply means for supplying a first RF voltage to the first pair of rods, and a second RF voltage supply means for supplying a second RF voltage to the second pair of rods to produce the RF field between the rods.

17. The mass spectrometer system as defined in claim 14 further comprising a mode selection means for selecting the selected mode of operation from a plurality of modes of operation, wherein each mode of operation comprises a trapping voltage sub-mode selected from a plurality of trapping voltage sub-modes, a selected DC voltage sub-mode selected from a plurality of DC voltage sub-modes, and, a selected excitation sub-mode selected from a plurality of excitation sub-modes.

18. The mass spectrometer system as defined in claim 17 wherein the mode selection means comprises a trapping voltage sub-mode selection means for selecting the selected trapping voltage sub-mode from the plurality of trapping voltage sub-modes; and the plurality of trapping voltage sub-modes is selected from the group comprising (i) an RF balanced sub-mode wherein an amplitude of the first RF voltage equals an amplitude of the second RF voltage, (ii) a first RF unbalanced sub-mode wherein the amplitude of the first RF voltage exceeds the amplitude of the second RF voltage, and (iii) a second RF unbalanced sub-mode wherein the amplitude of the first RF voltage is less than the amplitude of the second RF voltage.

19. The mass spectrometer system as defined in claim 17 wherein the mode selection means comprises a DC voltage sub-mode selection means for selecting the selected DC voltage sub-mode from the plurality of DC voltage sub-modes; and the plurality of DC voltage sub-modes is selected from the group comprising (i) a first DC sub-mode wherein a first positive DC voltage is applied to the first rod pair relative to the second rod pair, (ii) a second DC sub-mode wherein a second positive DC voltage is applied to the second rod pair relative to the first rod pair; and, (iii) a zero DC sub-mode wherein zero DC voltage is applied between the first rod pair and the second rod pair.

20. The mass spectrometer system as defined in claim 17 wherein the mode selection means comprises an excitation sub-mode selection means for selecting an excitation voltage sub-mode from the plurality of excitation sub-modes; and the plurality of excitation sub-modes is selected to be one or more of the group comprising (i) a first excitation sub-mode comprising providing an exit auxiliary AC voltage to the exit member, (ii) a second excitation sub-mode comprising providing a first dipole excitation AC voltage between the first pair of rods; (iii) a third excitation sub-mode comprising providing a second dipole excitation AC voltage between the second pair of rods; (iv) a fourth excitation sub-mode comprising providing a quadrupole excitation AC voltage between the first pair of rods and the second pair of rods; (v) a fifth excitation sub-mode comprising providing an exit auxiliary AC voltage to the exit member and providing the first dipole excitation AC voltage between the first pair of rods, (vi) a sixth excitation sub-mode comprising providing the exit auxiliary AC voltage to the exit member and providing the second dipole excitation AC voltage between the second pair of rods; (vii) a seventh excitation sub-mode comprising providing the exit auxiliary AC voltage to the exit member and providing an auxiliary quadrupole excitation AC voltage between the first pair of rods and the second pair of rods; (viii) an eighth excitation sub-mode comprising providing the first dipole excitation AC voltage between the first pair of rods and providing the second dipole excitation AC voltage between the second pair of rods; and, (ix) a ninth excitation sub-mode comprising providing the exit auxiliary AC voltage to the exit member, providing the first dipole excitation AC voltage between the first pair of rods and providing the second dipole excitation AC voltage between the second pair of rods.

* * * * *